US005754915A

United States Patent [19]

Masuda et al.

[11] Patent Number: 5,754,915

[45] Date of Patent: May 19, 1998

[54] AUTOMATIC PHOTOSENSITIVE MATERIAL DEVELOPING MACHINE AND PHOTOGRAPHIC PROCESSING SOLUTION REPLENISHING APPARATUS

[75] Inventors: Shigeru Masuda; Tsukasa Nakano; Masayuki Kojima; Masayuki Nakanishi; Toshihiko Nakano, all of Wakayama; Haruo Hakamada; Hideo Ishii, both of Hino, all of Japan

[73] Assignee: Noritsu Koki Co., Ltd., Wakayama, Japan

[21] Appl. No.: 750,676

[22] PCT Filed: Jun. 12, 1995

[86] PCT No.: PCT/JP95/01188

§ 371 Date: Dec. 13, 1996

§ 102(e) Date: Dec. 13, 1996

[87] PCT Pub. No.: WO95/34844

PCT Pub. Date: Dec. 21, 1995

[30] Foreign Application Priority Data

Jun. 14, 1994 [JP] Japan ..... 6-155191
Jun. 14, 1994 [JP] Japan ..... 6-155192

[51] Int. Cl.[6] ..... G03D 3/06

[52] U.S. Cl. ..... 396/626; 396/630

[58] Field of Search ..... 396/564, 626, 396/630, 636; 430/465

[56] References Cited

U.S. PATENT DOCUMENTS

| | | | |
|---|---|---|---|
| 5,318,061 | 6/1994 | Saito | 396/626 |
| 5,351,103 | 9/1994 | Komatsu et al. | 396/626 |
| 5,400,105 | 3/1995 | Koboshi et al. | 396/626 |
| 5,452,045 | 9/1995 | Koboshi et al. | 396/626 |

FOREIGN PATENT DOCUMENTS

| | | |
|---|---|---|
| 6-110176 A | 4/1994 | Japan . |
| 6-208215 A | 7/1994 | Japan . |
| 6-258809 A | 9/1994 | Japan . |
| WO 92/20013 A | 11/1992 | WIPO . |

*Primary Examiner*—A. A. Mathews
*Attorney, Agent, or Firm*—Frishauf, Holtz, Goodman, Langer & Chick

[57] ABSTRACT

An automatic photosensitive material developing machine supplies a solid processing solution to be dissolved according to consumption of processing solution for a silver halide photosensitive material to be treated. The developing machine includes a solid processing solution supplying section for supplying the solid processing solution from a solid processing solution cartridge containing the solid processing solution, and a solid processing solution transferring section for receiving the solid processing solution supplied by the solid processing solution supplying section in a bucket, and for transferring the bucket upward.

14 Claims, 39 Drawing Sheets

AUTOMATIC PHOTOSENSITIVE MATERIAL DEVELOPING MACHINE AND PHOTOGRAPHIC PROCESSING SOLUTION REPLENISHING APPARATUS

TECHNICAL ART

This invention relates to an automatic developing machine for photosensitive materials and a photographic processing solution replenishing apparatus having a reduced size, improved workability, highly improved chemical and stability and a reduced replenishment requirements.

BACKGROUND OF THE INVENTION

A silver halide photosensitive material (hereinafter sometimes referred to as a sensitive material or a photographic material), after being exposed, is subject to processes including development, desilverization, cleaning, and stabilization. In the development process, a black and white developing solution or a color developing solution is employed; in the desilverization process, a bleaching solution, a bleach fixing solution, and a fixing solution are employed; in the cleaning process, tap water or ion exchange water is employed; and in the stabilization process, stabilizing solution is employed. The solutions for carrying out these processes are known as photographic processing solution.

The processes can be carried out by an automatic photosensitive material developing machine (hereinafter sometimes referred to as an automatic developing machine), which allows a sensitive material to be sequentially transferred through tanks containing the above photographic processing solutions. The term automatic photosensitive material developing machine used herein refers generally to a developing machine including a development section, desilverization section, a cleaning or stabilization section, and a drying section and further including means for automatically transferring the photosensitive material in order.

For carrying out these processes with the automatic developing machine, a photographic processing solution replenishment system is in common and wide use to keep the activity of photographic processing solutions in the tanks constant. Specifically, a required amount of replenishing solution is supplied from each replenishing tank to each tank at appropriate times so as to ensure the proper functioning of the respective of the processes. In this system, it is common that the replenishing solutions themselves to be stored in the replenishing tanks are produced in a different location from the replenishing tanks and are supplied to the tanks as needed. In addition, the following manual steps are generally performed.

Photographic processing solutions for a silver halide photosensitive material (hereinafter sometimes referred to as a photographic processing solution), which are commercially available in the form of powder or concentrated liquid, are prepared into adequate solution for practical use by manually dissolving the concentrated powder in a required amount of water or diluting the concentrated liquid with a required amount of water. Some replenishing tanks are placed alongside the photosensitive material developing machine and require substantive space for placement of them. Further, the recently increasingly popular mini laboratory is structured so that the replenishing tanks are incorporated in the automatic photosensitive material developing machine, but it is still required to find room for placing the replenishing tanks in the machine.

If the automatic developing machine is modified such that the processing tanks in which the processing solutions for treating silver halide photosensitive material are stored are associated with dissolution tanks in such a manner that solid processing solutions can be supplied to and dissolved in the dissolution tanks according to consumption of the processing solutions, the following results can be acheived: that the automatic developing machine is downsized; that the manual work for dissolution is eliminated; that processing system is improved in stability of photographic performance; and that low-pollution system is achieved which is capable of saving or eliminating the use of plastic containers which are in general use for storing the photographic processing solutions.

In this modification, when a solid processing solution supplying section is located over the dissolution tanks associated with the processing tanks so that the solid processing solutions can be dropped directly from the solid processing solution supplying section into the processing tanks, the supply mechanism can be simplified in structure. However, some automatic developing machines can have difficulty in locating the solid processing solution supplying section at a position over the dissolution tanks': For example, there may be cases where the solid processing solution supplying section could hinder maintenance of the processing tanks or the dissolving tanks. Also, when the solid processing solution supplying section is in humid surroundings, condensation occurs to contribute to a development of rust and leak. Even if some moisture protection is given to the solid processing solutions vulnerable to humidity, the solid processing solutions can absorb some moisture to cause alternation in quality and deterioration in supply with their expanding into a mass, sticking together, or sticking to other elements. To avoid these problems, it may be practical that the solid processing solution supplying section for allowing the solid processing solutions to be supplied to the related processing solutions is arranged at a location different from the processing tanks and the dissolving tanks. For realization of such an arrangement, it comes to be an important issue how to smoothly supply the solid processing solutions without being caught or clogged when supplied in one row or more rows.

Further, the solid processing solutions are held in a solid processing solution cartridge. For providing adequate room for the cartridge and ensuring its operability, the cartridge may be required to be loaded by for example its being inserted into the solid processing solution supplying section disposed vertically. With this structure for the cartridge to be loaded by insertion, the solid processing solution cartridge is easy to drop. Because of this, a locking mechanism or equivalent is provided so that the cartridge can be locked when inserted for attachment and be unlocked for removal for replacement of it. With the locking mechanism, configuration it is impossible for an operator to attach and remove the cartridge with his/her one hand. In addition, at the time of unlocking the locking mechanism and removing the solid processing solution cartridge, it is necessary for the operator to hold the cartridge inconveniently with his/her both hands. Besides, providing the locking mechanism requires an increase in the number of parts and leads to complicated structure and reduced reliability. Also, when the locking mechanism is unlocked, care is needed not to drop the solid processing solution cartridge and thus it is difficult to use.

Further, after the solid processing solution cartridge is set to the solid processing solution supplying section, the solid processing solutions in the cartridge are supplied by operation of the solid processing solution supplying section. Disadvantageously, the solid processing solution supplying section can operate when the time has come to supply the solid processing solutions, even if the cartridge is not yet set in the solid processing solution supplying section for, for example, replacement of the cartridge. When the solid processing solution supplying section operates with the solid processing solution cartridge not yet set in the solid processing solution supplying section, there may arise a problem in that dust or paper occurring in the work may drop into a solid processing solution inlet opening to cause a jamming which contributes to machine trouble.

This invention has been made with the aim of solving the above problems. It is the object of the invention as set forth in claims 1 to 8 to provide an automatic photosensitive material developing machine which enables a smooth and sure transference and supply of the solid processing solutions, with a structure which is simple and compact in size, when the solid processing solution supplying section is provided at a location different from the processing tanks and the dissolving tanks and which is also below those tanks.

It is the object of the invention as set forth in claims 9 to 11 to provide a photographic processing solution replenishing apparatus which enables elimination of possible problems occurring when the solid processing solutions are supplied from the solid processing solution cartridge set vertically. Especially, it is the object of the invention as set forth in claim 9 to provide a photographic processing solution replenishing apparatus which enables the solid processing solutions, when supplied, to be collected and be smoothly supplied without hitching or jamming. Further, it is the object of the invention as set forth in claims 10 and 11 to provide a photographic processing solution replenishing apparatus which enables the solid processing solution cartridge to be held by means of a simple structure to provide improved workability.

Also, the object of the invention as set forth in claims 12 and 13 is to provide a photographic processing solution replenishing apparatus which enables the solid processing solution cartridge to be easily attached or detached with one hand to provide a further improved operability. Further, the object of the invention as set forth in claim 14 is to provide a photographic processing solution replenishing apparatus which enables a solid processing solution inlet provided in the solid processing solution supplying section to be protected against clogging of rust, paper or the like to diminish a risk of malfunction and machine trouble, so as to achieve improved durability.

SUMMARY OF THE INVENTION

To achieve the above objects, according to the invention of claim 1, an automatic photosensitive material developing machine, for supplying a solid processing solution to be dissolved according to consumption of processing solution for a silver halide photosensitive material to be treated, comprises a solid processing solution supplying section for allowing the solid processing solution to be supplied from a solid processing solution cartridge containing said solid processing solution, and a solid processing solution transferring section for allowing the solid processing solution discharged from the solid processing solution supplying section to be contained in a bucket and be transferred upward.

The invention according to claim 2 is featured in that the automatic photosensitive material developing machine, further comprises carriage path for allowing the solid processing solution delivered from said bucket to be carried toward the processing tanks.

The invention according to claim 3 is featured in that said solid processing solution transferring section is located between said solid processing solution supplying section and said processing tanks.

The invention according to claim 4 is featured in that said bucket is movable up and down along a cover and has a bottom slanted toward the cover, so that said solid processing solution contained in the bucket is carried upward with said cover and is fed into said carriage path at a position corresponding to an opening formed on the cover.

The invention according to claim 5 is featured in that two or more solid processing solutions are contained in said bucket via a partition plate(s) and also are supplied into said carriage path at positions corresponding to openings which are so formed on a cover as to be different in vertical level from each other.

The invention according to claim 6 is featured in that said bucket is movable up and down along a cover and the solid processing solution contained in said bucket is movable upward and can be brought into contact with a cam guide, with its upward movement, so as to be pushed out by said cam guide at a position corresponding to an opening formed on said cover, so as to be fed into said carriage path.

The invention according to claim 7 is featured in that said bucket is movable up and down along a cover and thus the solid processing solution contained in said bucket is movable upward, said bucket being tilted by a cam at a position corresponding to an opening formed on said cover so that the solid processing solution can be fed into said carriage path.

The invention according to claim 8 featured in that said bucket is formed so that it can move up and down along a cover, together with a bucket holder and a shutter for preventing the solid processing solution contained in said bucket from contacting with said cover, said shutter being prevented from its upward movement in the course of the upward movement of said bucket by a shutter stopper provided before an opening formed on the cover, whereby said bucket can be raised together with said bucket holder and the solid processing solution contained in said bucket can be fed into said carriage path at a position corresponding to the opening formed on the cover.

The invention according to claim 9 is directed toward a photographic processing solution replenishing apparatus, for supplying solid processing solutions to be dissolved according to consumption of processing solutions for a silver halide photosensitive material to be treated. The apparatus comprises a dropping track for allowing the plurality of solid processing solutions to drop by gravity into a plurality of supplying paths for the solid processing solutions to be fed in, said dropping track comprising a plurality of dropping passages which permit the solid processing solutions at the endpoints of the dropping track to be kept in substantially the same attitude, said photographic processing solution replenishing apparatus further comprising a solid processing solution transferring section for transferring the solid processing solutions to the endpoints of said dropping track.

The invention according to claim 10 is directed toward a photographic processing solution replenishing apparatus, for supplying solid processing solutions to be dissolved according to consumption of processing solutions for a silver halide photosensitive material to be treated wherein a solid processing solution cartridge containing the solid processing solutions, is inserted therein. The apparatus comprises a solid processing solution supplying section, which is constituted so that said solid processing solution cartridge can be set in a position for the solid processing solutions to be supplied from, and a holding means, for preventing drop of said solid processing solution cartridge, provided at a position where said solid processing solution cartridge containing the solid processing solutions is inserted.

The invention according to claim 11 is featured in that said holding means for holding said solid processing solution cartridge is formed of spring steel.

The invention according to claim 12 is featured in that said holding means for holding said solid processing solution cartridge is formed by a solid processing solution cartridge holding element which is provided at the front ends thereof with rollers.

The invention according to claim 13 is featured in that the holding means for holding the solid processing solution cartridge is formed by a solid processing solution cartridge holding element which is provided at the front ends thereof with folded portions having slippery members at the inside thereof.

The invention according to claim 14 is also directed toward a photographic processing solution replenishing apparatus for supplying solid processing solutions to be dissolved according to consumption of processing solutions for a silver halide photosensitive material to be treated wherein a solid processing solution cartridge containing the solid processing solutions, is inserted therein. The apparatus comprises a solid processing solution supplying section, which is constituted so that said solid processing solution cartridge can be set in a position for the solid processing solutions to be supplied from, and a sensing means for sensing an inserting motion of said solid processing solution cartridge inserted, so that a resulting signal issued from the sensing means enables the solid processing solution supplying section to operate to supply the solid processing solutions contained in the solid processing solution cartridge.

According to the invention of claim 1, in the case where the solid processing solution supplying section is located at a place different from the processing tanks and the dissolving tank and below those tanks, the solid processing solution delivered from the solid processing solution supplying section can be carried upward with its contained in the bucket. This can provide the results that with the structure simplified by use of the upward movement of the buckets, the automatic developing machine can be made compact in size and also a smooth and reliable carriage of the solid processing solutions can be ensured.

According to the invention of claim 2, after the solid processing solutions delivered from the solid processing solution supplying section are carried upward with their contained in the buckets, the solid processing solutions delivered from the buckets are transported toward the processing tanks by the carriage paths. This ensures a smooth and reliable carriage of the solid processing solutions toward the processing tanks.

According to the invention of claim 3, the solid processing solution transferring section is located between the solid processing solution supplying section and the processing tanks. This enables the automatic developing machine to be made compact in size and also enhances a smooth and reliable carriage of the solid processing solutions to the processing tanks.

According to the invention of claim 4, the bottom of the bucket is slanted to the cover, and the solid processing solution contained in the bucket is carried upward with its held by the cover and is fed into the carriage path at an opening provided at the cover. This can provide the result that the solid processing solution can be carried with simple structure using the bucket in combination with the cover.

According to the invention of claim 5, two or more solid processing solutions are carried upward by the bucket and are supplied into the carriage path at openings which are so formed on the cover as to be different in vertical level from each other. Thus, surplus upward movement can be omitted so that the time required to supply the solid processing solutions can be shortened, while also the two or more solid processing solutions can be carried upward and fed toward the processing tanks, with simple structure.

According to the invention of claim 6, the solid processing solution moving upward is brought into contact with the cam guide and is pushed out by the cam guide at a position corresponding to the opening formed on the cover. Thus, the supply of the solid processing solution to the carriage path can be made with simple structure utilizing the upward movement of the solid processing solution.

According to the invention of claim 7, the bucket is tilted by the cam at a position corresponding to an opening formed on the cover. Thus, the supply of the solid processing solution to the carriage path can be effected with simple structure using the cam.

According to the invention of claim 8, the solid processing solution, contained in the bucket movable upward along the cover, can be protected from contacting with the cover to avoid wear or fly-off the worn solid processing solution, when it is carried upward and fed into the carriage paths. Also, only the shutter can be hindered from its upward movement by the shutter stop provided before (beneath) the opening of the cover, so that the bucket and the bucket holder can be further raised together. This ensures that the solid solution contained in the bucket is fed toward the processing tanks from the opening of the cover.

According to the invention of claim 9, a dropping track, which is for allowing the plurality of solid processing solutions to drop by gravity into a plurality of supplying paths for the solid processing solutions to be fed in, comprises a plurality of dropping passages and permits the solid processing solutions at the endpoints of the dropping track to be kept in substantially the same attitude. Thus, a plurality of solid processing solutions can be collected and supplied smoothly without clogging or jamming.

According to the invention of claim 10, a holding means for preventing drop of the solid processing solution cartridge is provided at a position where the solid processing solution cartridge containing the solid processing solutions is inserted. Thus, the solid processing solution cartridge can be held by the holding means with a simple insertion loading. This allows the solid processing solution cartridge to be held with simple structure and also allows an operator to attach or detach the cartridge even with his/her one hand, thus proving improved workability.

According to the invention of claim 11, the holding means for holding the solid processing solution cartridge is formed of spring steel, so that for example simply bending a sheet of spring steel allows the solid processing solution cartridge to be grasped and held so as not to drop. This requires the reduced number of parts and adjustment-free, thus enabling the holding means to be hard to breakage and ensuring the holding action.

According to the invention of claim 12, the solid processing solution cartridge holding element is provided at the front ends thereof with rollers. Free rotation of the rollers which occurs when the solid processing solution cartridge is attached or detached facilitates the attachment or detachment of the solid processing solution cartridge with one hand, thus providing further improved operability.

According to the invention of claim 13, the solid processing solution cartridge holding element is provided at the front ends thereof with folded portions each having a slippery member at the inside. At the time of attaching or detaching the solid processing solution cartridge, sliding effect of the slippery members facilitates the attachment or detachment of the solid processing solution cartridge with one hand.

According to the invention of claim 14, the solid processing solution cartridge inserted in the solid processing solution supplying section is sensed by the sensing means, and the sensing result determines the operation of the solid processing solution supplying section. This can avoid a possible risk that the solid processing solution supplying section may operate under the state that rust, paper or the like is in an solid processing solution inlet of the solid processing solution supplying section. Thus, the clogging of rust, paper or the like can be prevented and a possible risk of machine trouble or malfunction can be diminished, thereby achieving improved durability.

BEST MODE FOR CARRYING OUT THE INVENTION

Next, one example of the photosensitive material developing machine to which the invention is applicable will be described with reference to the drawings.

Figure 1:
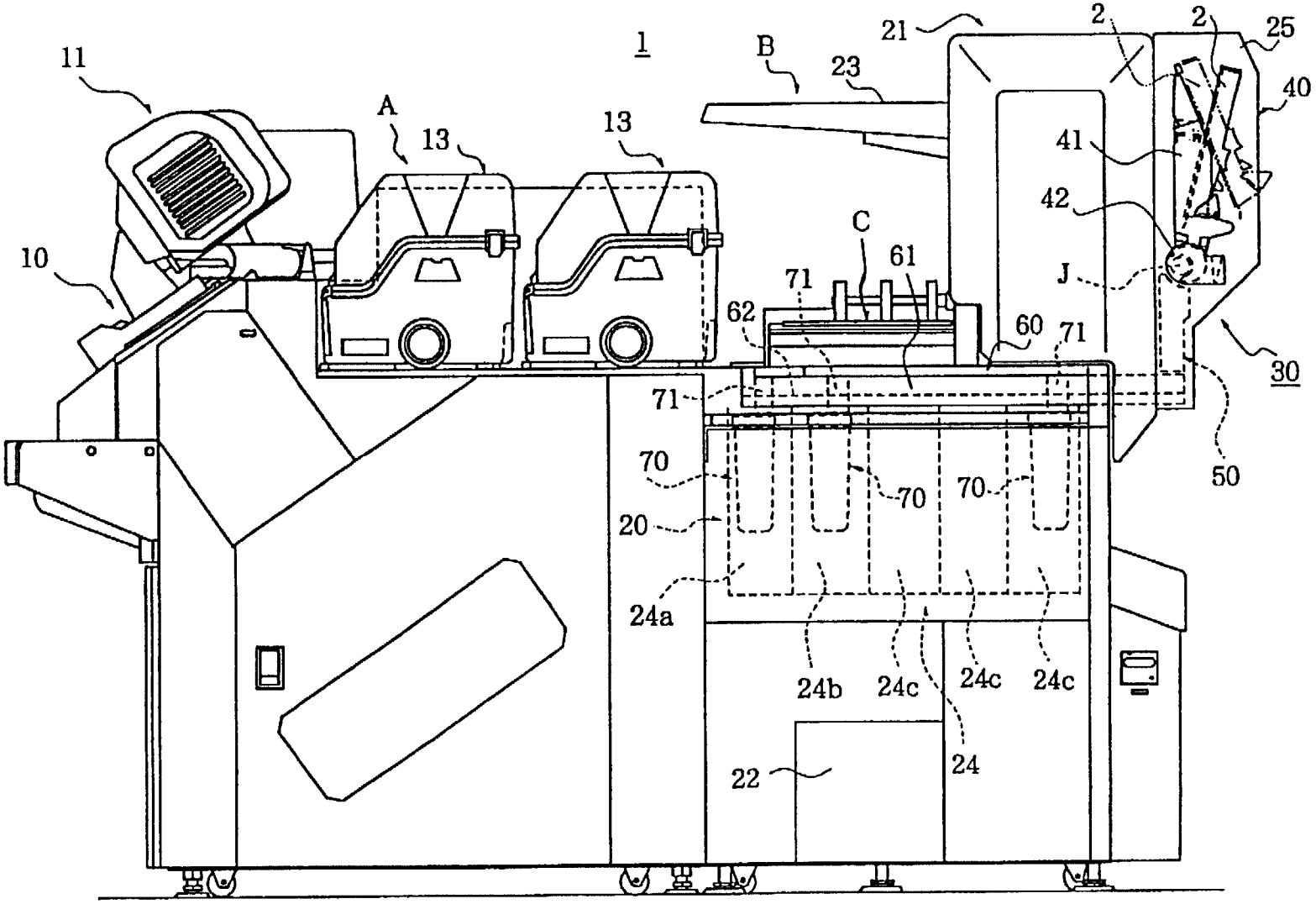
FIG. 1 is a front view of a photosensitive material developing machine.
Figure 2:
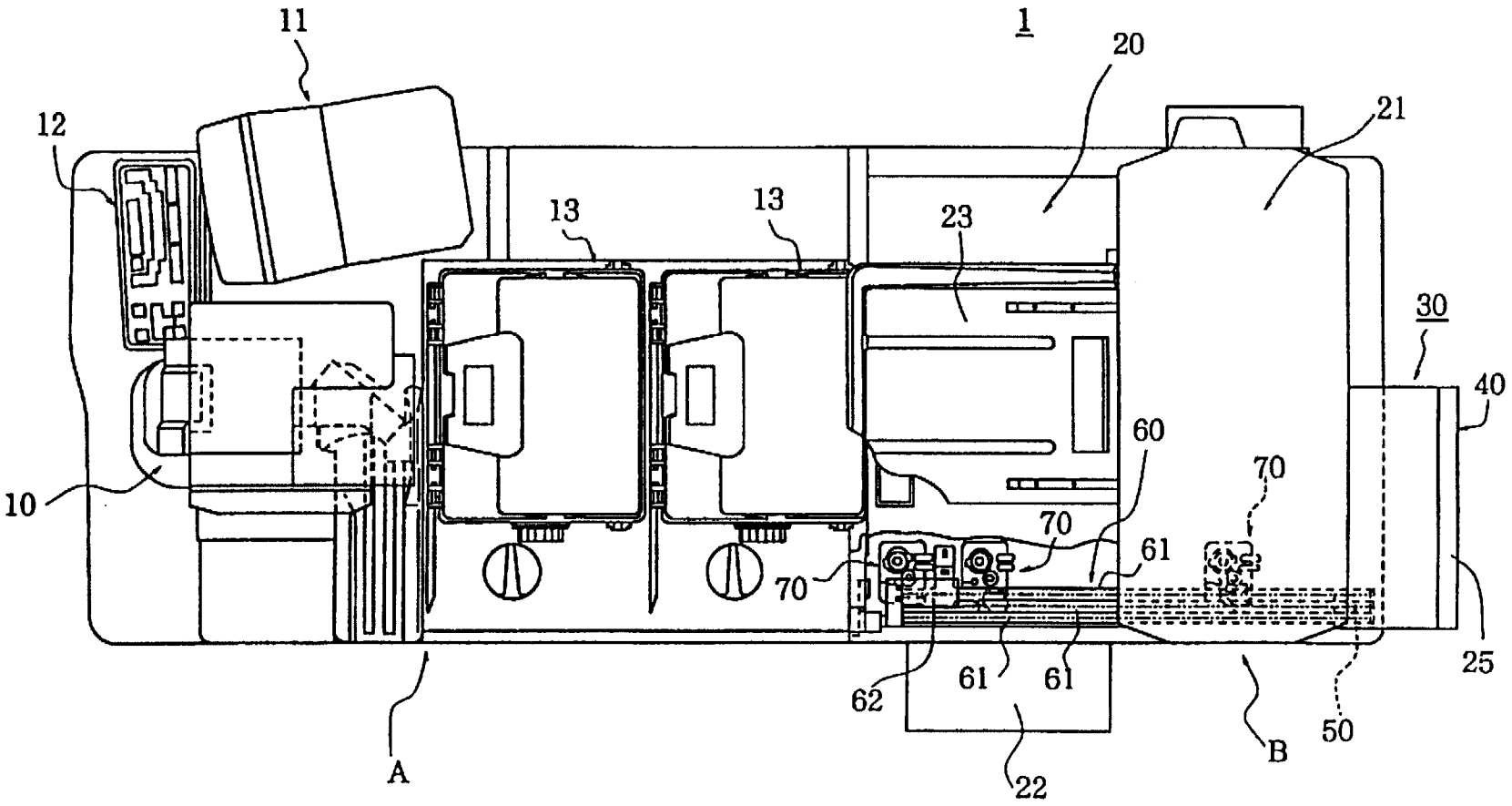
FIG. 2 is a plan view of the photosensitive material developing machine.
Figure 3:
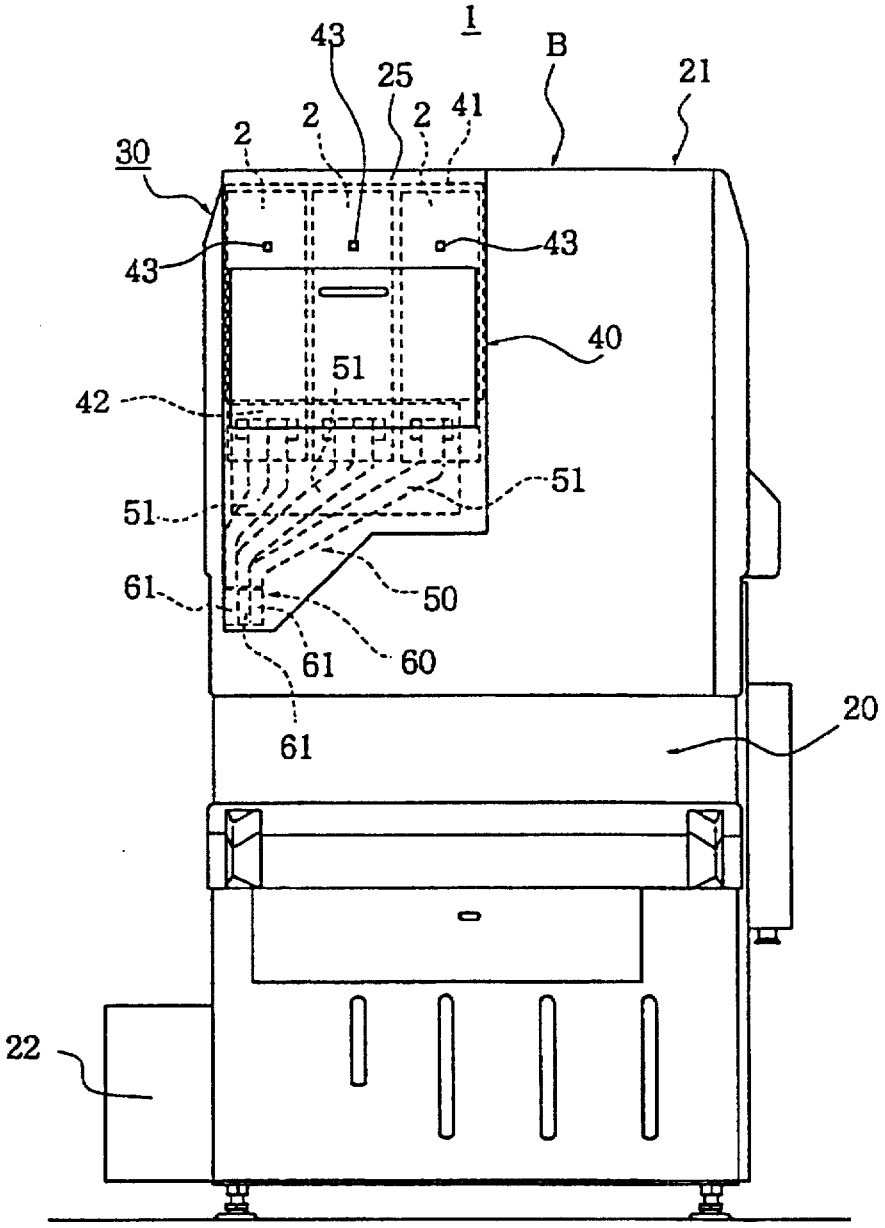
FIG. 3 is a right side view of the photosensitive material developing machine.
Figure 4:
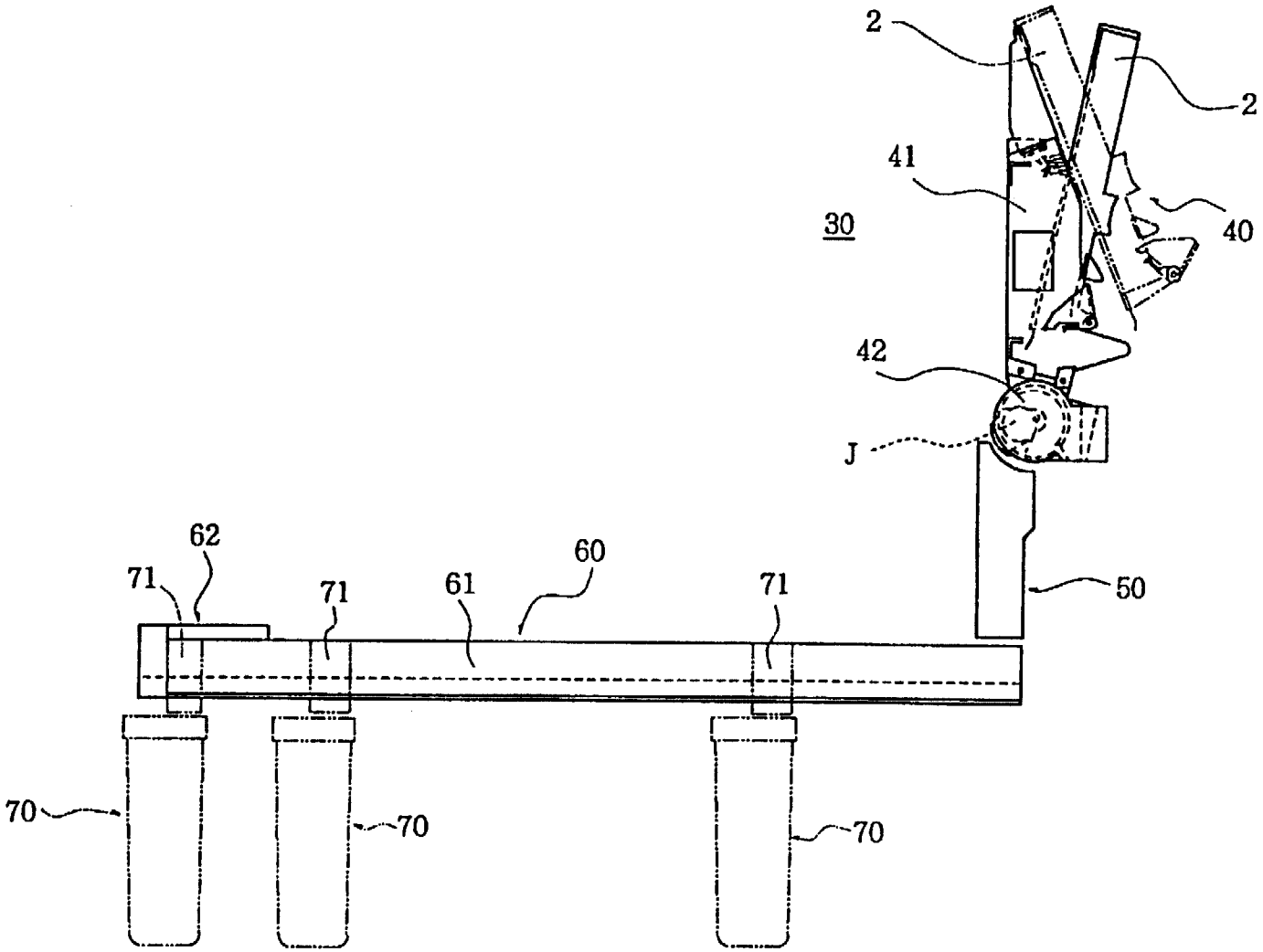
FIG. 4 is a diagram of carriage path of solid processing solution.

The following detailed description first deals with a photosensitive material developing machine in which a solid processing solution supplying section is located at a location different from processing tanks and above the processing tanks. Referring to the drawing, FIG. 1 is a front view of the photosensitive material developing machine; FIG. 2 is a plan view of the photosensitive material developing machine; FIG. 3 is a right side view of the photosensitive material developing machine; and FIG. 4 is a diagram of carriage path of solid processing solution.

A photosensitive material developing machine 1 comprises a photo printing machine A integral with an automatic paper developing machine B for developing a photographic paper. The photo printing machine A comprises a printing section 10, a display section 11, and an operating section 12. On an upper part of the machine, magazine storing sections 13 are mounted to set magazines each containing a rolled printing paper which is an unexposed, silver halide photosensitive material. In the printing section 10 of the photo printing machine A, photographic image is subjected to exposure on the printing paper drawn out of the magazine in the magazine storing section 13. The exposed printing paper is introduced into the automatic paper developing machine B.

The automatic paper developing machine B comprises a processing section 20, a drying section 21, and a controlling section 22. The printing paper is subjected to development process in the processing section 20 and then to drying in the drying section 21 to thereby produce a photographic print, and thereafter the resulting print is carried to a pan of an order sorting machine not shown or a recovery table 23 to be retrieved therefrom. The processing section 20 includes processing tanks 24 comprising a color development tank 24*a*, a bleaching-fixing tank 24*b*, and a three-tier stabilizing tank 24*c*. The printing paper is transferred in order through these processing tanks so that it can be subjected to color development process, bleaching and fixing process, and stabilization process, respectively. It is noted that while the automatic paper developing machine B is described herein as comprising practically three-tier tank comprising a color development tank, a bleaching-fixing tank and a stabilizing tank, it is not necessarily limited to this construction. The automatic paper developing machine may alternatively comprise practically four-tier tank comprising a color development tank, a bleaching tank, a fixing tank, and a stabilizing tank.

The automatic paper developing machine B includes a photographic processing solution replenishing apparatus 30 for allowing solid processing solution J to be added to the color development tank 24*a*, the bleaching-fixing tank 24*b*, and the stabilizing tanks 24*c*. The photographic processing solution replenishing apparatus 30 comprises a solid processing solution supplying section 40, a solid processing solution collecting section 50, a solid processing solution transferring section 60 and dissolving tanks 70.

The solid processing solution supplying section 40 and the solid processing solution collecting section 50 are housed in a case 25 which is attached to a side wall of the drying section 21. The solid processing solution supplying section 40 comprises a loading portion 41 and a supplying portion 42 which are arranged for respective dissolving tanks 70. The loading portion 41 loads solid processing solution cartridges 2 each containing the solid processing solutions J to be used for the processing solution in each of the processing tanks 24. The supplying section 42 operates so that solid processing solutions J can be fed from a selected solid processing solution cartridge 2.

Figure 5:
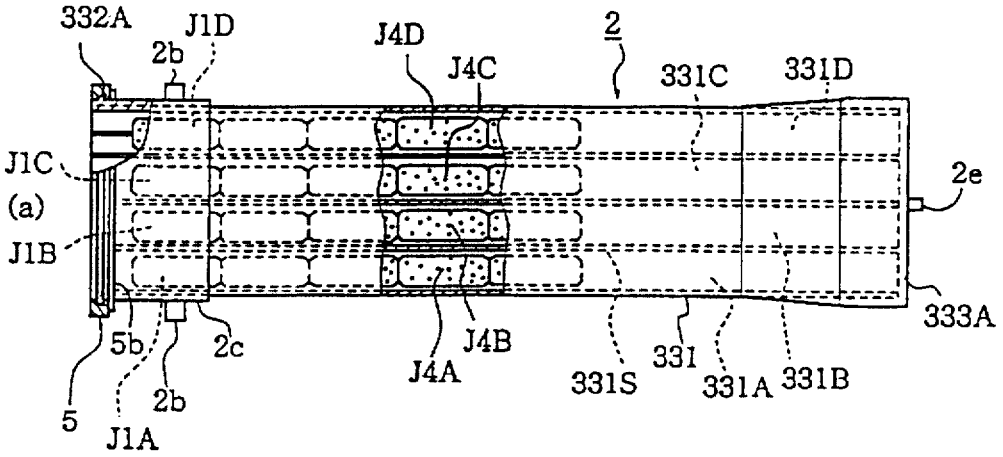
FIGS. 5(*a*)–5(*c*) are views showing a solid processing solution cartridge.
Figure 5:
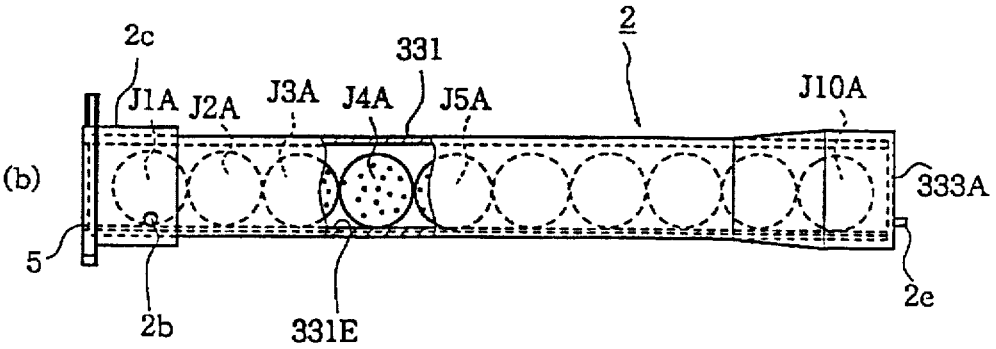
Figure 5:
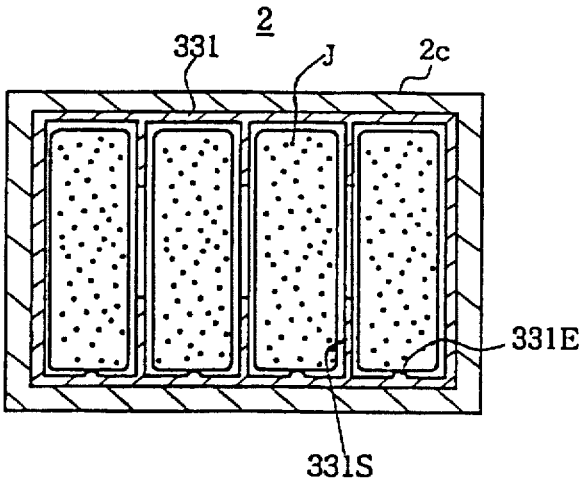

The following detailed description deals with the solid processing solution cartridge 2. FIG. 5(*a*)–5(*c*) illustrate views of the solid processing solution cartridge 2 containing a tablet type of solid processing solution J. FIG. 5(*a*) is a plan view including a partially broken section of the same; FIG. 5(*b*) is a side elevation view of the solid processing solution cartridge 2; and FIG. 5(*c*) is a front view of an opening of the solid processing solution cartridge 2 from which a sliding lid 5 is removed.

The solid processing solution cartridge 2 comprises a container body 331 of a hollow square pole-like shape, able to contain two or more tablets of solid processing solutions J; an outlet member 2*c* having an aperture which communicates with an opening at one end of the hollow container body 331 and permits the solid processing solutions to be delivered therefrom; and the sliding lid 5 movable up and down along a track portion 332A of the outlet member 2*c*.

Three partition walls 331S are fixed to an inside of the container body 331 so as to be integral therewith, so that the inside of the container body 331 is partitioned into four divided rooms 331A, 331B, 331C and 331D. With contacting with an outer periphery of each solid processing solution J having a generally cylindrical shape, each of the divided rooms can contain about ten tablets of solid processing solutions J in a tandem arrangement. Specifically, the first divided room 331A contains ten solid processing solutions J1A–J10A, the second divided room 331B does equal numbers of solid processing solutions J1B–J10B, and likewise the third and fourth divided rooms contain equal numbers of solid processing solutions J1C–J10C and J1D–J10D, respectively.

Each divided room of the container body 331 is provided at the bottom thereof with a projecting bar 331E which makes a point contact with the outer periphery of the solid processing solution J to facilitate movement of the solid processing solution J. The projecting bar allows powder fallen out of the solid proceeding solution J to be dropped from the top of the projection bar 331 E. The powder fallen out of the solid processing solution J falls from the projecting bar 331E and collects in a grooved part of the bottom. Thus, the powder stuck to the grooved part could not give any harm because the solid processing solution J moves on the projection bar 331 E.

Tracks 332A are formed on two opposite outside sides of outlet aperture of the outlet member 2*c* and are slidably fit into grooves 5*b* formed on two opposite sides of the sliding lid 5. Projections 5*a* projecting from two opposite ends of a lower portion of the sliding lid 5 are engaged with an open-close regulation member 121 mentioned later so that the sliding lid 5 can be automatically opened or closed. Further, pins 2*b* project from two opposite sides of the outlet member 2*c* so as to be inserted into guide grooves 109D of the loading portion 41 mentioned later.

The solid processing solution cartridge 2 is pressed at its rear surface 333A by a pressing member 114C of the loading portion 41 mentioned later so as to be press-fitted on a reference plane of the supplying portion 42. Discriminating pins 2*e* are formed on the rear surface 333A of the solid processing solution cartridge 2 so as to be integral therewith, in order to prevent a wrong setting of a wrong selected solid processing solution cartridge 2.

Figure 6:
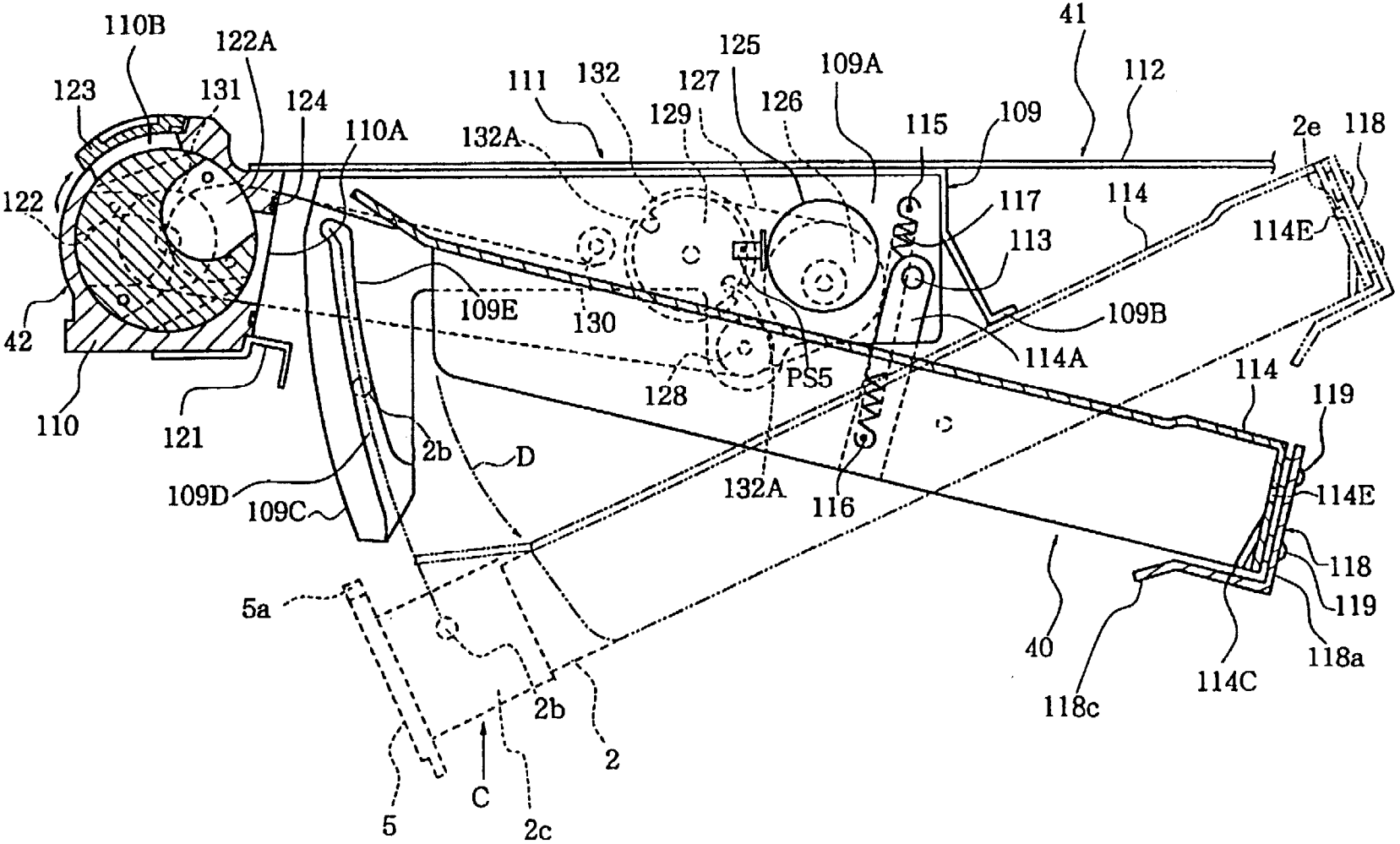
FIG. 6 is a sectional view of a solid processing solution supplying section.
Figure 7:
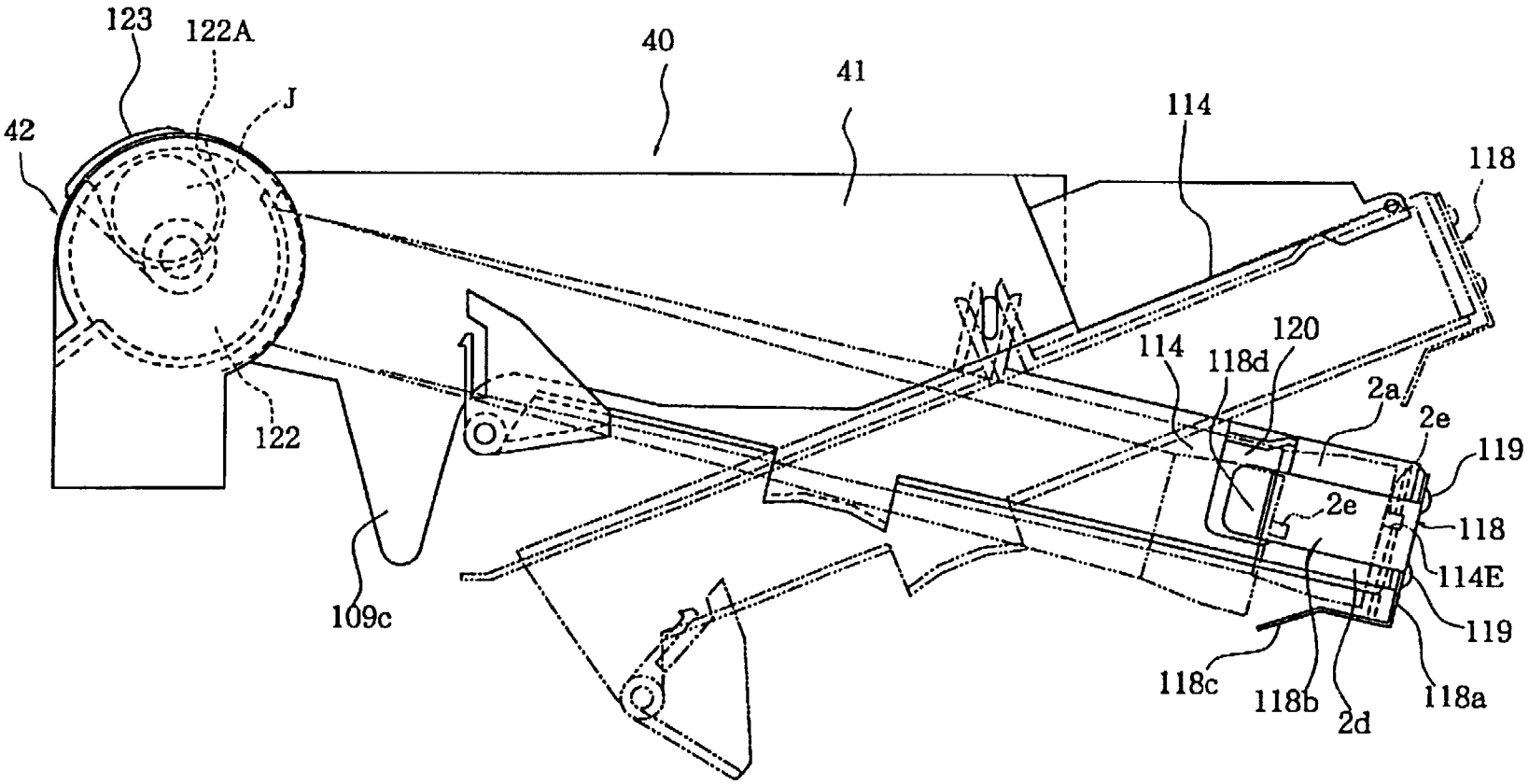
FIG. 7 is a side view of the solid processing solution supplying section.
Figure 8:
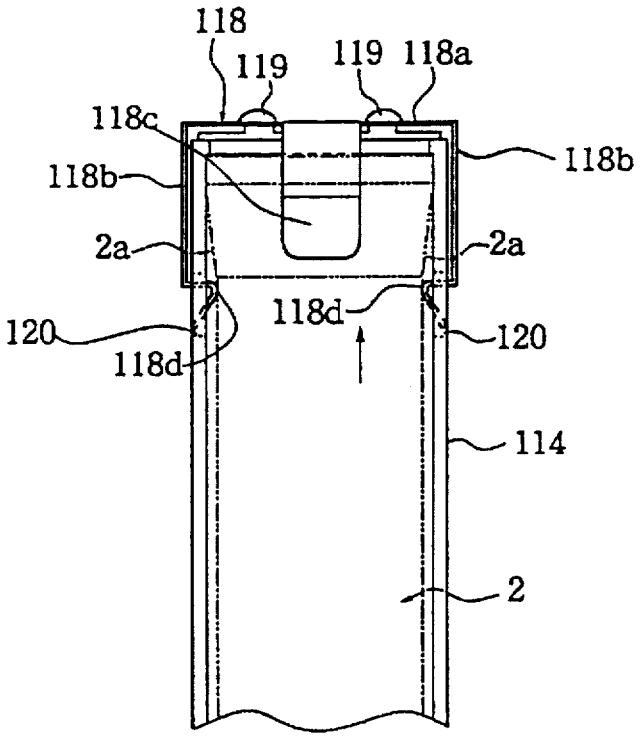
FIG. 8 is a front view of a part of the solid processing solution supplying section.
Figure 9:
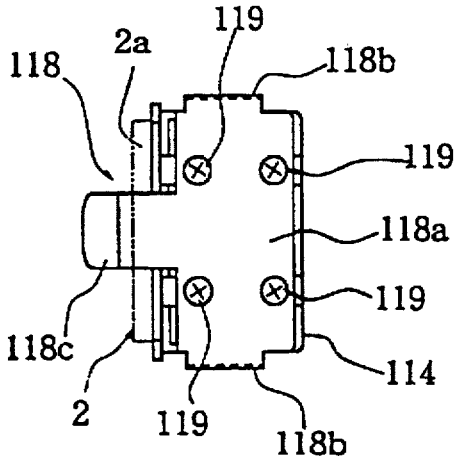
FIG. 9 is a plan view showing a holding means in an attaching condition.
Figure 10:
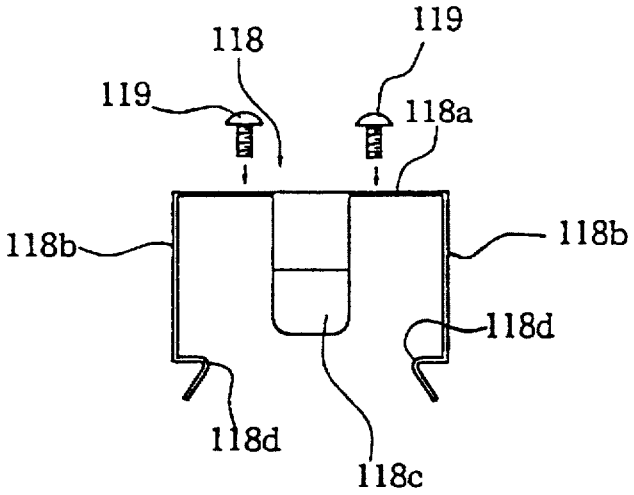
FIG. 10 is a exploded perspective view of the holding means.
Figure 11:
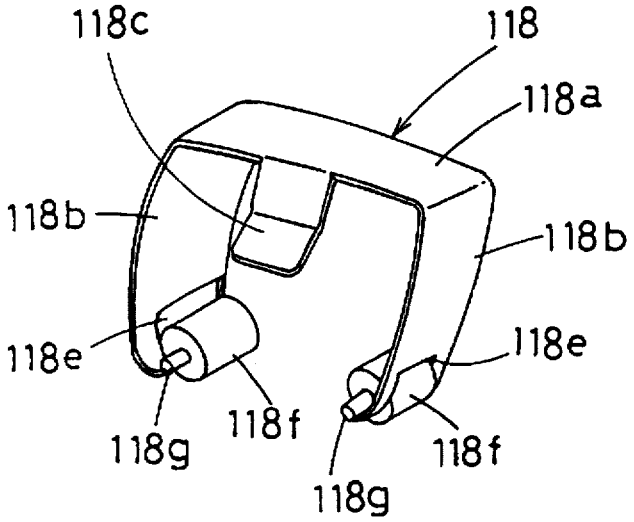
FIG. 11 is a perspective view of a variant of the holding means.
Figure 12:
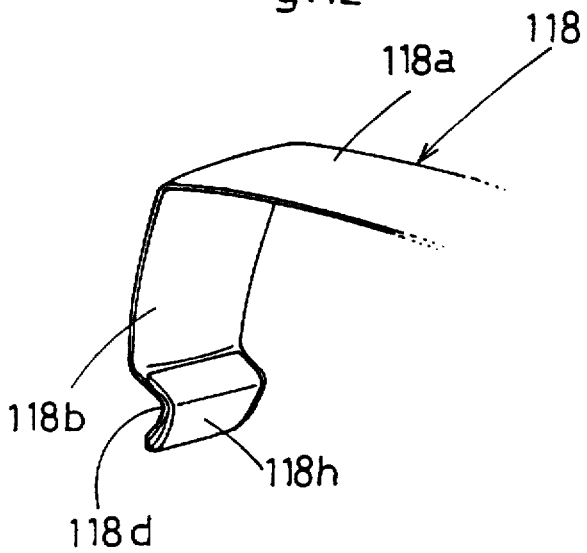
FIG. 12 is a perspective view of a main part of another variant of the holding means.

The following detailed description deals with the solid processing solution supplying section 40. FIG. 6 is a sectional view of the solid processing solution supplying section; FIG. 7 is a side view of the solid processing solution supplying section; FIG. 8 is a front view of a part of the solid processing solution supplying section; FIG. 9 is a plan view showing a holding means in an attaching condition; FIG. 10 is a exploded perspective view of the holding means; FIG. 11 is a perspective view of a variant of the holding means; and FIG. 12 is a perspective view of a main part of another variant of the holding means.

A fixed frame 109, a housing 110 integral with the fixed frame, and a driving means 111, of the loading portion 41 of the solid processing solution supplying section 40, are fixed at a side of a unit body 112. A support shaft 113 projects from both side plates 109A of the fixed frame 109 at the nearly upper end thereof, as viewed in the figure. The support shaft fits in a hole of each of arms 114A fixed to both sides of a holding member 114 to hold the solid processing solution cartridge 2. The holding member 114 is thus adapted to swing around the support shaft 113. Fixing pins 115, 116 are planted on each of the side plates 109A and each of the arms 114A, and tension springs 117 are provided under tension between the fixing pins. Thus, the holding member 114 is energized to swing in a clockwise direction, as shown by a chain line, and is allowed to be held in its original position before loading, with its stopped at a front left position at which a bottom of the holding member 114 abuts to a stopper 109B projecting toward top left as viewed in the figure.

The holding member 114 is provided with a holding means 118 for holding the solid processing solution cartridge 2 at the top portion thereof in which the solid processing solution cartridge 2 is inserted. The holding means 118 is formed of spring steel and is made by a sheet of spring steel being folded into a U-like shape to form a mounting portion 118*a* and holding portions 118*b* at each side of the mounting portion 118*a*. Further, the mounting portion 118*a* is folded at the center part to form a guide portion 118*c*. Each of the holding portions 118*b* is folded inside in a protruding manner at the front end to form a bending portion 118*d*.

The holding means 118 is clamped to the holding member 114 with its mounting portion 118*a* fixed to a top end of the holding member 114 with screws 119 and its holding portions 118*b* catching an upper portion of the holding member 114 from the outside. The bending portions 118*d* formed at the front ends of the holding portions 118*b* project inside from windows 120 formed on both sides of the holding member 114 and engage with stepped portions 2*a* formed on two opposite sides of the solid processing solution cartridge 2, so as to hold the solid processing solution cartridge 2. The guide portion 118*c* provided at a forward part of the holding means 118 serves as a guide for the solid processing solution cartridge 2 when inserted from below.

The each fixed frame 109 is provided at the nearly bottom part thereof with a rising portion 109C, in which a guide slot 109D of a circular shape centering around the support shaft 113 is provided. After loaded with the solid processing solution cartridge 2, the holding member 114 is pushed to swing around the support shaft 113, so that a bottom end portion of the holing member 114 is pressed in a direction shown by C as illustrated. The guide pins 2*b* of the solid processing solution cartridge 2 then move into the guide slots 109D while they are pressed by the pressing member 114C of the holding member 114. The furthest part of the guide slot 109D is formed to be an I-shaped slot 109E with its bent into a I-like shape. When guide pins 2*b* of the solid processing solution cartridge 2 pressed by the pressing member 114C are moved into the I-shaped slot 109E, a forward part of the outlet member 2*c* of the solid processing solution cartridge 2 is brought into close relation with an inlet 110A of the housing 110 of the supplying portion 106.

At a forward part of the inlet 110A of the housing 110 of the supplying portion 42 is fixedly provided a open-close regulation member 121 for regulating the opening and closing of the sliding lid 5. When the solid processing solution cartridge 2 is pushed from its original position (a chain line as illustrated) in a direction of C as illustrated to an intermediate position, the projections 5*a* of the sliding lid 5 is restrained from moving further by the open-close regulation member 121. When the solid processing solution cartridge 2 is pushed further to be swung, since the sliding lid 5 is held stationary, an aperture of the outlet member 2*c* of the solid processing solution cartridge 2 is gradually opened. When the solid processing solution cartridge 2 is thrust up to a position to be stopped, the opening is fully opened, so that the one at the forefront of the solid processing solutions in the solid processing solution cartridge 2 is fed into the supplying portion 106.

The supplying portion 42 comprises the housing 110; a rotatable rotor 122, rotatably housed in the housing 110 and having a pocket portion 122A, for receiving a required amount of solid processing solution J from the inlet 110A and moving it to the outlet 110B; and a shutter member 123 to open or close the outlet 110B.

Around a marginal portion of the aperture at the end of the inlet 110A of the housing 110 a frame-like elastic packing 124 is embedded, so that, when the aperture of the solid processing solution cartridge 2 comes to be in close contact with the inlet 110A, airtight can be made to enhance moisture proof efficiency.

The loading portion 41 includes the driving means 111: A timing belt 127 running on a timing pulley 126 fixed to a driving shaft of a motor 125 allows a pulley 131 fixedly mounted on a rotary shaft of the rotors 122 to be rotated via pulleys 128, 129 and a tension pulley 130.

A notched disk 132 having two notches is integral with the same shaft as the pulley 129. An optical sensor of photo-interrupter type PS5 detects passing of the notches 132A and issues a position detecting signal so that control of one stopping cycle of the rotor 122 can be effected.

Thus, the solid processing solution supplying section 40 includes a process of inserting the solid processing solution cartridge 2 containing the solid processing solutions from below to above and is constituted such that the solid processing solution cartridge 2 can be set in a position for the solid processing solution J to be supplied from. The loading portion 41 of the solid processing solution supplying section 40 is provided, at its inserting portion for the solid processing solution cartridge 2 to be inserted in, with the holding means 118 for holding the solid processing solution cartridge 2. When the solid processing solution cartridge 2 is inserted in the loading portion from below to above, as shown by a two-dot chain line in FIG. 6, two opposite sides of the fore end 2*d* of the cartridge 2 are brought into contact with the bending portions 118*d* formed at the holding portions 118*b* of the holding means 118 and then the bending portions are expanded toward the outside by the thrusting motion of the cartridge, as shown in FIGS. 7 and 8. Then, the fore end 2d of the solid processing solution cartridge 2 is further thrust in the loading portion, with its guided by the guide portion 118*c*, until the discriminating pins 2*e* at the solid processing solution cartridge 2 come to fit in the related positioning holes 114E at the holding member 114. The insertion of the cartridge is made in this way.

When the insertion of the solid processing solution cartridge 2 brings the bending portions 118*d* formed at the front ends of the holding portions 118*b* into engagement with the stepped portions 2*a* formed at the two opposite sides of the solid processing solution cartridge 2, the inserting operation is completed, so that the solid processing solution cartridge 2 is held in place by the holding means 118. With the solid processing solution cartridge 2 held in place like this, the holding member 114 is thrust in the direction of C, as described on FIG. 6, whereby the solid processing solution cartridge 2 is set in place.

To replace the solid processing solution cartridge 2, the holding member 114 is moved in the direction of D reversing the inserting direction, with the result that the solid processing solution cartridge 2 comes to be in a position shown by two-dot chain line in FIG. 6. In this position, the solid processing solution cartridge 2 is held by the holding means 118 and thus is prevented from dropping. In this state, when the solid processing solution cartridge 2 is pulled out downward, the stepped portions 2*a* formed at the two opposite sides of the solid processing solution cartridge 2 force the bending portions 118*d* formed at the front ends of the holding portions 118*b* to be expanded toward the outside, so that easy release from the engagement can be made.

Thus, the solid processing solution cartridge 2 can be held in place with simple structure and can be attached or detached by an operator even with his/her one hand, thereby providing an improved workability.

In addition, since the holding means 118 for holding the solid processing solution cartridge 2 is formed of spring steel, for example simply folding a sheet of spring steel is required to surely grasp the solid processing solution cartridge 2 and hold it in place not to be dropped off. This can yield the results of reduced number of parts; elimination of the need for adjustment; good resistance to damage; and sure operation.

Shown in FIG. 11 is a modified holding means 118 drawn in perspective. This holding means is formed by folding a sheet of spring steel in such a manner that a guide portion 118*c* can be formed at a center part of a mounting portion 118*a* and holding portions 118*b* can be formed at each side of the mounting portion 118*a*, likewise the former embodiment. Each of the holding portions 118b is slightly folded inside at the front end and also is cut out to define a rectangular-shaped cutout 118e. In the each cutout 118e a roller 118f is supported via a shaft 118g so as to be freely rotatable.

By insertion of the solid processing solution cartridge 2, the rollers 118f at the front ends of the holding portions 118b are rotated and are brought into engagement with the stepped portions 2a formed at two opposite sides of the solid processing solution cartridge 2, with the result that the solid processing solution cartridge 2 is held in place by the holding means 118.

Thus, the rollers 118f at the front ends of the holding portions 118b facilitate the insertion operation of the solid processing solution cartridge 2 with one hand. Also, the removal operation of the solid processing solution cartridge 2 from the holding means 118 can be easily made with one hand, with the help of free rotation of the rollers 118f at the front ends of the holding portions 118b.

Shown in FIG. 12 is another modified holding means 118 drawn in perspective. In this variant, the bending portion 118d at the front end of each holding portions 118b is provided at the inside thereof with slippery member 118h. The provision of the slippery member 118h at the bending portion 118d can also facilitate the attachment or detachment of the solid processing solution cartridge. Further, instead of using the slippery member 118h, applying a slid-acceleration solution to the inside surface of the bending portion 118d can provide equal effect.

In the above embodiments, the holding means formed of spring steel is taken as an example, while it may be formed of another materials including resins such as PC (polycarbonate) or PVC (polyvinyl chloride) or other elastic materials. The holding means formed of resins is advantageously easy to mold, light in weight and is good in strength.

Figure 13A:
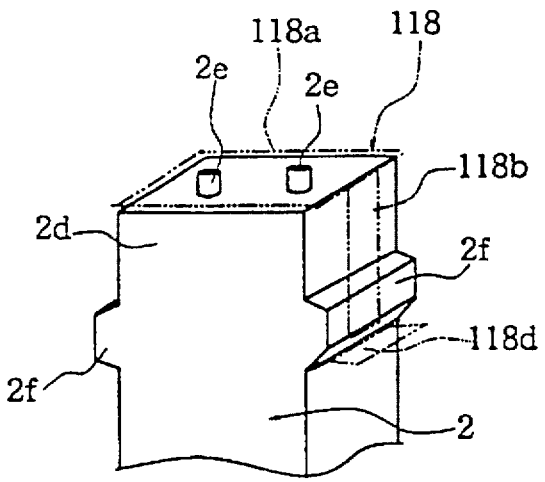
FIGS. 13(*a*) and 13(*b*) are views showing a modified solid processing solution cartridge.
Figure 13B:
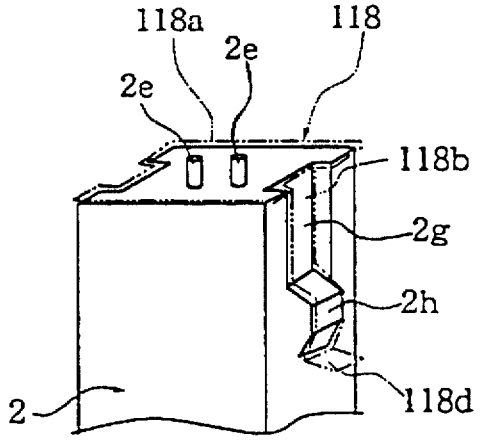

FIGS. 13(*a*) and (*b*) illustrate modified solid processing solution cartridges 2. In FIG. 13(*a*), the solid processing solution cartridge 2 is provided with projections 2f at the two opposite sides of the front end portion 2d thereof. The solid processing solution cartridge 2, when inserted from below, causes each bending portion 118d of the holding means 118 to override each projection 2f and then engage with it at a position beyond the projection 2f, and thereby the cartridge is surely held in position. In FIG. 13(*b*), the solid processing solution cartridge 2 is provided at the two opposite sides thereof with grooves 2g and also is provided at the front ends of the grooves 2g with projections 2h. Thus, the solid processing solution cartridge 2, when inserted from below in the same manner, causes the each holding portion 118b of the holding means 118 to be inserted into each groove 2g, with its surely held by the groove. The cartridge inserted further causes the each bending portion 118d to override the each projection 2h and then engage with it at a position beyond the each projection 2h, and thereby the cartridge is surely held in position.

Figure 14A:
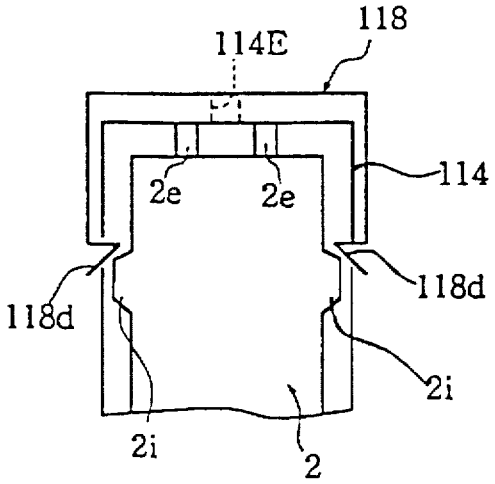
FIGS. 14(*a*) and 14(*b*) show a modification to restrict insertion of the solid processing solution cartridge.
Figure 14B:
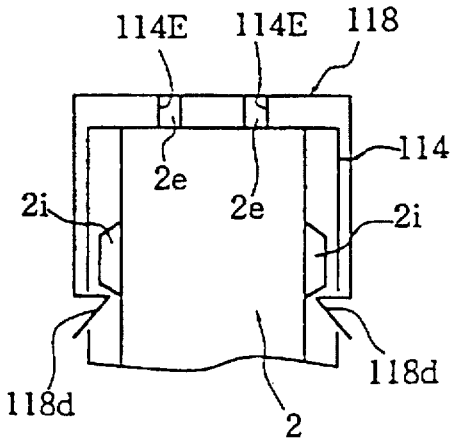

FIG. 14(*a*) and 14(*b*) show a modification to restrict insertion of a different type solid processing solution cartridge. In FIG. 14(*a*), a solid processing solution cartridge 2 has on its top two discriminating pins 2e, whereas a holding member 114 has only one hole 114E and also the hole is provided at a different location, so that the pins cannot fit in the holes. Due to this, each bending portion 118d of holding means 118 is not allowed to override each projection 2i and engage with it at a position beyond the each projection 2i. Thus, any wrong type cartridge 2 cannot be held in place. On the other hand, in FIG. 14(*b*), the holding member 114 has two holes 114E and also the holes are provided at corresponding locations, so that the discriminating pins 2e of the solid processing solution cartridge 2 can befit into the holes 114E of the holding member 114. Due to this, the each bending portion 118d of the holding means 118 is allowed to override the each projection 2i and then engage with it at a position beyond the projection 2i. This ensures that an appropriate type cartridge 2 is held in place by the holding means 118.

Figure 15:
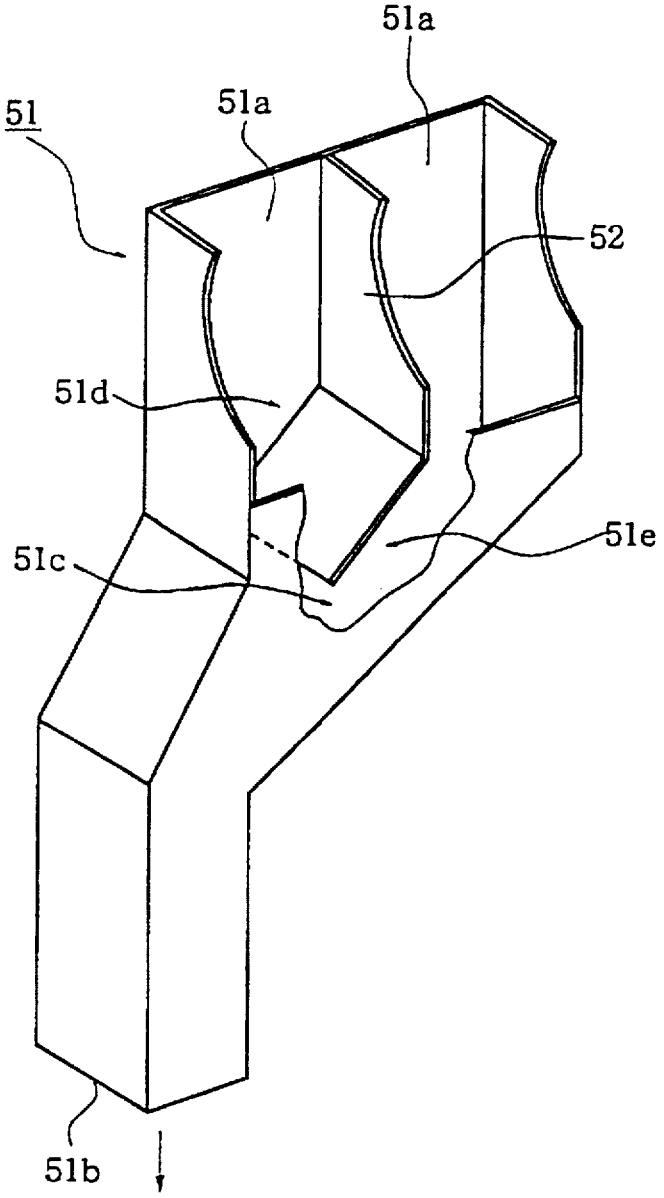
FIG. 15 is a perspective view of a collecting unit.
Figure 16:
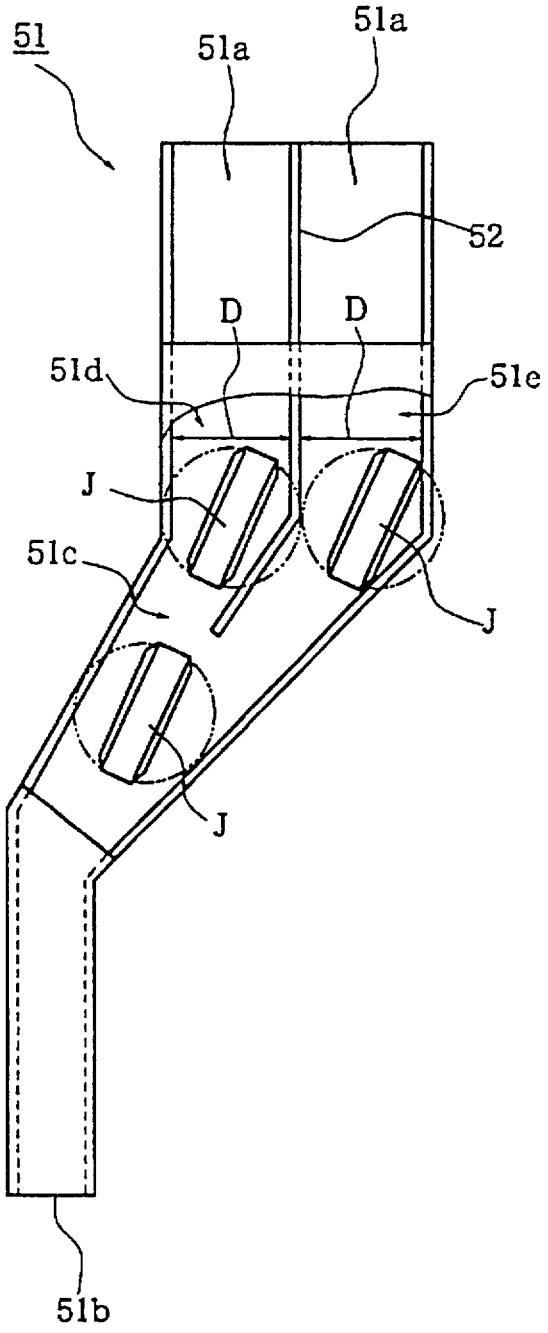
FIG. 16 is fragmentary side view partially broken away of the collecting unit.

The following detailed description deals with the solid processing solution collecting section 50. FIG. 15 is a perspective view of a collecting unit, and FIG. 16 is fragmentary side view partially broken away of the collecting unit.

In the solid processing solution collecting section 50, collecting units 51 are arranged corresponding in position to the processing tanks 24, as shown in FIG. 3. Each collecting unit 51 is located between the supplying portion 42 of the solid processing solution supplying section 40 and carriage paths 61 of the solid processing solution transferring section 60. The solid processing solutions J supplied from the supplying portion 42 of the solid processing solution supplying section 40 are allowed to drop by gravity into the collecting units 51 and are fed into the corresponding carriage paths 61 of the solid processing solution transferring section 60 through the collecting units 51.

In other words, the solid processing solution collecting section 50 comprises the dropping track for allowing a plurality of solid processing solutions J to drop by gravity into a plurality of supplying paths for the solid processing solutions J to be fed in through the collecting units 51. The each dropping track comprises a plurality of dropping passages. The dropping passages are different from each other in the angle between each of the dropping passages and the vertical so as to allow the solid processing solutions at the endpoints of the dropping track to be kept in substantially the same attitude. Further, the dropping track includes the solid processing solution transferring section 60 for allowing the solid processing solutions to be carried to the endpoints of the dropping track. The solid processing solution transferring section 60 comprises the carriage paths 61 and a carriage means 62. The solid processing solutions J supplied to the carriage paths are transferred by the carriage means 62 and are supplied to guide portions 71 of the dissolving tanks 70 which are so arranged as to communicate with their associated processing parts 24.

The case 25 is provided with operating lamps 43 related for solid processing solution cartridges 2. The operating lamps come to illuminate when the supplying portion 42 starts to operate and remains on until the supply of the solid process solutions J is ended, so as to indicate by a light an operation status for an operator.

Among the collecting units 51, the one which is provided in association with the supplying section 42 for allowing a supply of the solid processing solutions J to be fed into the dissolving tank 70 provided in the processing tank 24 of the color development tank 24a is constructed as shown in FIGS. 15 and 16. This collecting unit 51 is formed by a shooter having upper openings 51a located in confront with the supplying portion 42 of the solid processing solution supplying section 40 and a lower opening 51b located in confront with the carriage paths 61 of the solid processing solution transferring section 60. Further, the collecting unit 51 comprises the dropping track for allowing solid processing solutions J to drop by gravity into the supplying path 51c for the solid processing solutions J to be fed in. The supplying path 51*c* of the dropping track comprises a plurality of dropping passages 51*d*, 51*e* defined by a guide 52. The dropping passages 51*d*, 51*e* are different from each other in the angle between each of the dropping passages and the vertical so as to allow the solid processing solutions at the endpoints of the dropping track to be kept in substantially the same attitude.

Like this, the collecting unit 51 comprises the dropping track comprising the plurality of dropping passages 51*d*, 51*e* for allowing the solid processing solutions to drop by gravity into the 51*c* for the solid processing solution J to be fed in. The solid processing solutions J delivered from the supplying portion 42 of the solid processing solution supplying section 40 are supplied from the upper openings 51*a*. As shown in FIG. 16, each of the dropping passages defined by the guide 52 is so formed as to have a width D smaller than a diameter of the solid processing solution J shown by a two-dot chain line. These passages 51*d*, 51*e* enable the solid processing solutions to be restricted from their turning at some midpoints in the passages, so that the solid processing solutions J at the endpoints of the dropping track can be kept in substantially the same attitude. Hence, when the solid processing solutions J are supplied in one row or in two or more rows, the solid processing solutions J can be collected into the lower opening 51*b* without hitching or clogging, thus achieving a smooth supplying of the solid processing solutions.

It is to be noted that while the supplying path of the dropping track of the collecting unit 51 in the above embodiment comprises two dropping passages 51*d*, 51*e* defined by one guide 52, it may comprise three or more passages defined by two or more guides.

Further, the remaining collecting units 51, which are provided in association with the supplying section 42 for allowing a supply of the solid processing solutions J to be fed into the dissolving tanks 70 in the processing tanks 24 comprising the bleaching-fixing tank 24*b* and the stabilizing tanks 24*c*, are all constructed in the same manner. In this embodiment, however, the one which is located in association with the supplying section 42 for allowing a supply of the solid processing solutions J to be fed into the dissolving tank 70 in the processing tanks 24 of the stabilizing tanks 24*c*comprises a single dropping passage without providing any guide. The number of the dropping passages provided in each of the collecting units 51 may be determined depending on the amount of the solid processing solutions required to be supplied in a given time.

Figure 17:
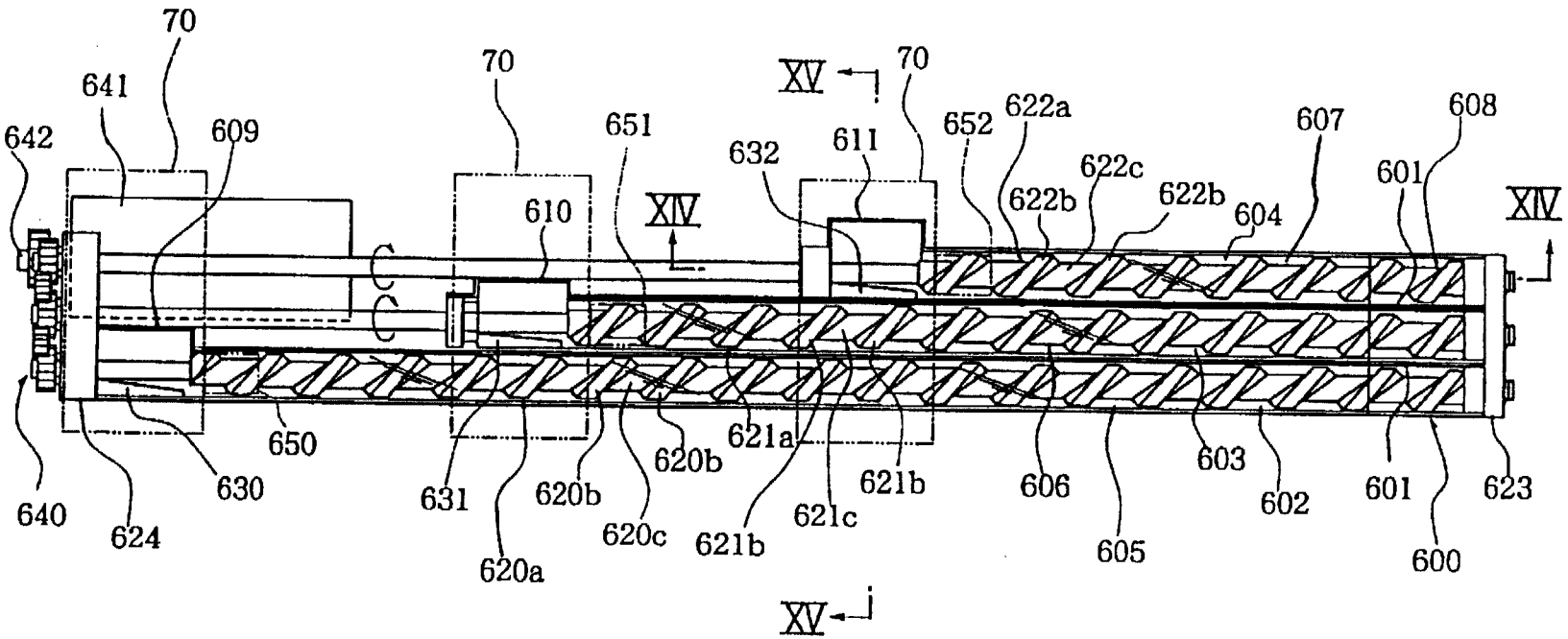
FIG. 17 is a plan view of a solid processing solution transferring section.
Figure 18:
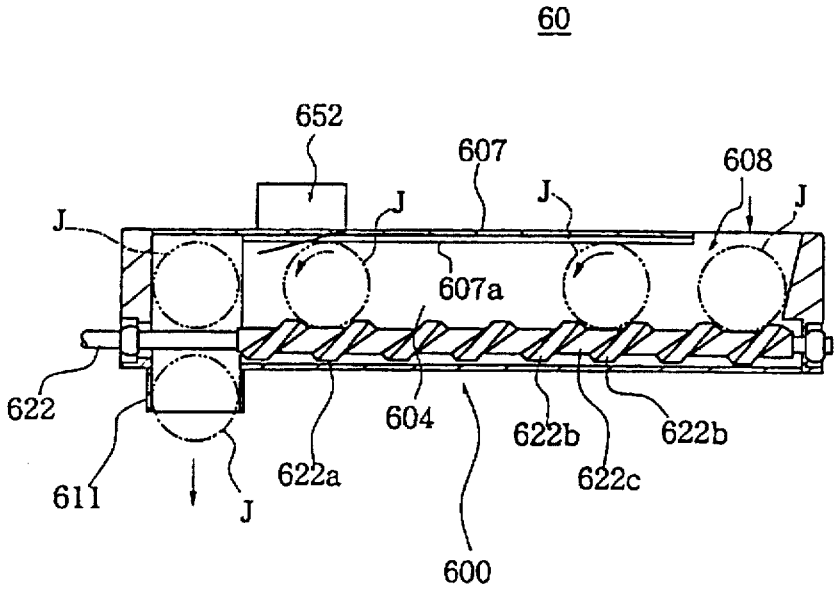
FIG. 18 is a sectional view taken along the line of XIV—XIV of FIG. 13.
Figure 19:
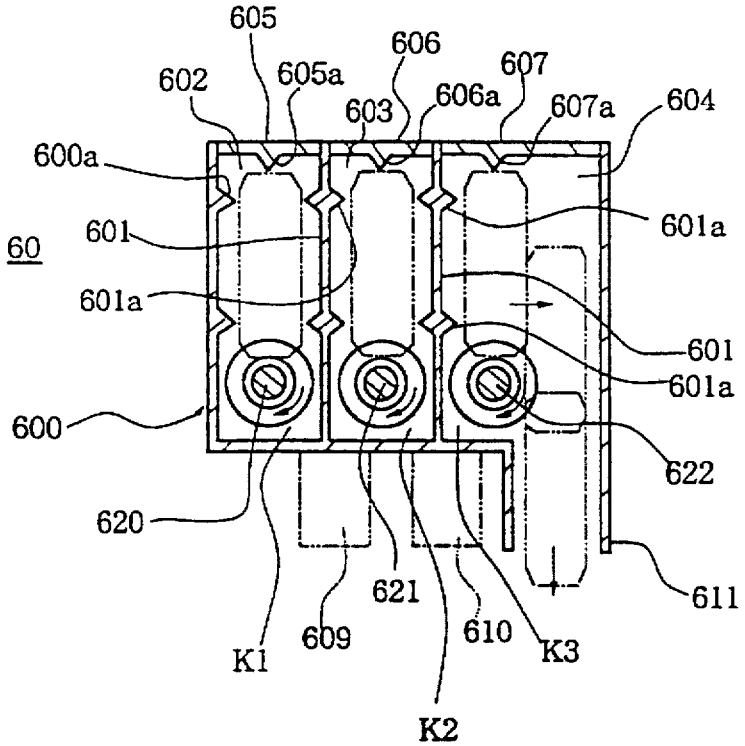
FIG. 19 is a sectional view taken along the line of X V—X V of FIG. 13.
Figure 20:
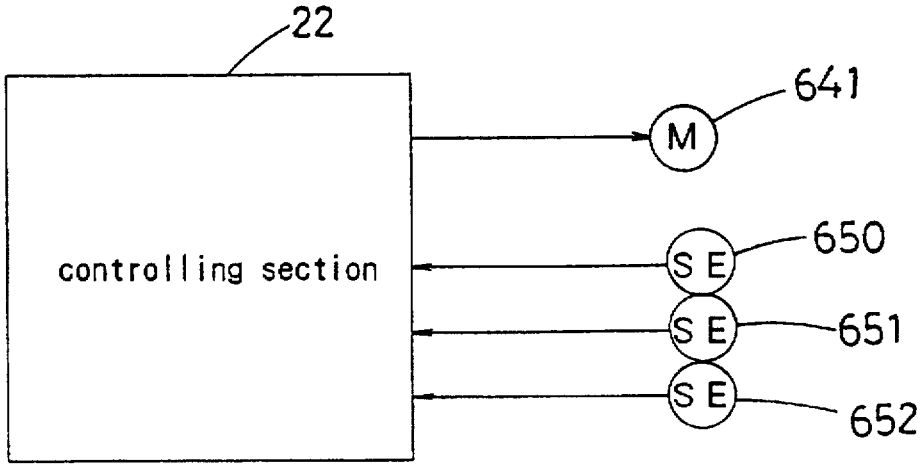
FIG. 20 is a diagram of control circuit of the solid processing solution transferring section.
Figure 21:
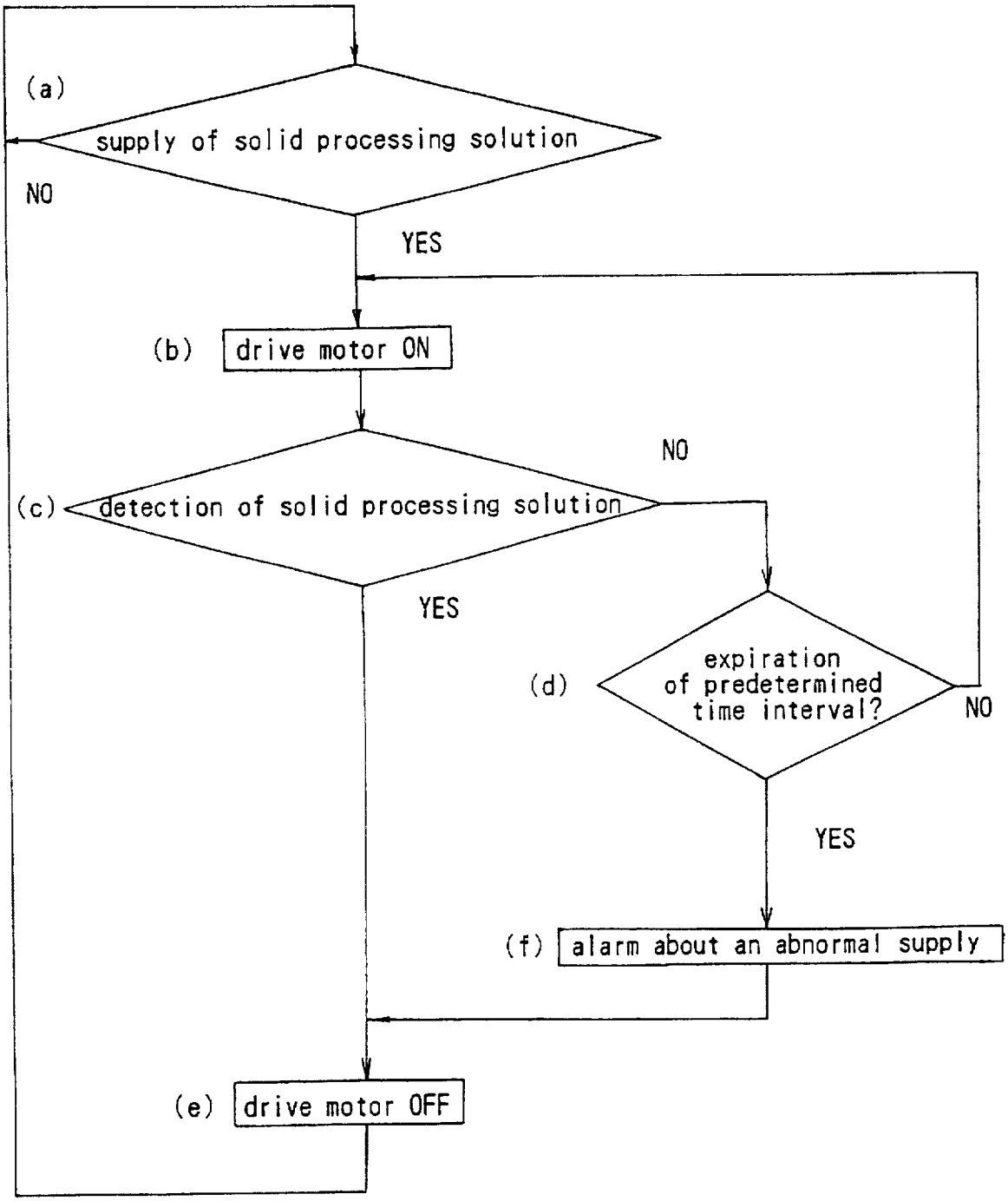
FIG. 21 is a flowchart of operation of the solid processing solution transferring section.

The following detailed description deals with the solid processing solution transferring section 60. FIG. 17 is a plan view of the solid processing solution transferring section; FIG. 18 is a sectional view taken along the line of XIV—XIV of FIG. 17; FIG. 19 is a sectional view taken along the line of X V—X V of FIG. 17; FIG. 20 is a diagram of control circuit of the solid processing solution transferring section; and FIG. 21 is a flowchart of operation of the solid processing solution transferring section.

The solid processing solution transferring section 60 is placed along a location over the dissolving tanks 70 at a front portion of an automatic paper developing machine B. A box frame 600 of the solid processing solution transferring section 60 is formed of substantially transparent materials such as transparent synthetic resins. In the box frame 600, partitioned walls 601 are integrally formed to define the first carriage path 602 for solid processing solutions J to be supplied to the dissolving tank 70 in the color development tank 24*a*, the second carriage path 603 for solid processing solutions J to be supplied to the dissolving tank 70 in the bleaching-fixing tank 24*b*, and the third carriage path 604 for solid processing solutions J to be supplied to the dissolving tank 70 in the stabilizing tanks 24*c*.

The first carriage path 602, the second carriage path 603 and the third carriage path 604 extend to a location over the dissolving tanks 70 from a location under the solid processing solution collecting section 50. These paths are respectively covered with lids 605, 606 and 607 formed of substantially transparent materials such as transparent synthetic resins, so as to define rooms of K1, K2 and K3. The term of substantially transparent materials used herein refers to materials which allow the interior of the rooms to be inspected from the outside.

The box frame 600 is provided with a supply opening 608 at a location in confront with the solid processing solution collecting section 50. Through the supply opening 608 solid processing solutions J are fed into the first carriage path 602, the second carriage path 603 and the third carriage path 604. Further, the box frame 600 is provided with shooters 609, 610 and 611 disposed at locations over their related dissolving tanks 70. From the shooters 609–611 the solid processing solutions J are fed into their related dissolving tanks 70.

The first carrier shaft 620, the second carrier shaft 621 and the third carrier shaft 622, all of which are helical, extend in the rooms K1–K3 defined by the first carriage path 602, the second carriage path 603 and the third carriage path 604 and are rotatably supported at the opposite ends thereof by support plates 623 and 624. The second carrier shaft 621 and the third carrier shaft 622 are rotatably supported by the shooters 610, 611 as well.

Further, the first carrier shaft 620, the second carrier shaft 621 and the third carrier shaft 622 are respectively provided with screwed portions 620a–622*a*, each of which extends between the part thereof corresponding in position to the supply opening 608 of the box frame 600 and the part thereof corresponding in position to its related shooter 609–611. Each solid processing solution J is held in a root 620*c*–622*c* between a crest 620*b*–622*b* and an adjacent crest 620*c*–622*c* of each screwed portion and is transferred axially while rotating by rotation of the first carrier shaft 620, the second carrier shaft 621 and the third carrier shaft 622. The first carrier shaft 620, the second carrier shaft 621 and the third carrier shaft 622 serve as a transferring means, having a constant pitch with which an endless transferring motion of a solid processing solution in a specific room is made, and housed in the specific room.

Restraining projection bars 600*a*, 601*a* and 605*a*–607*a* are formed on the box frame 600, the partition walls 601 and the lids 605–607, respectively, along a transferring way. The restraining projection bars 600*a*, 601*a* and 605*a*–607*a* restrain each solid processing solution J from moving out of position in order not to be broken in the transfer.

Guide plates 630–632 for allowing solid processing solutions J to be dropped are provided at locations corresponding to the related shooters 609–611. When solid processing solutions J carried via the first, second and third carrier shafts 620, 621,622 arrive at the locations corresponding to the related shooters 609–611, they come out of the screwed portions 620*a*–622*a* and are placed on the non-screwed shaft portions. When the solid processing solutions J are transferred up to those locations, they are pushed by the guide plates 630–632 toward locations over the shooters 609–611 oriented in a direction orthogonal to the axial direction and also are forced to move toward the locations over the shooters 609–611, oriented in a different direction from the axial direction, with rotation of the first, second and third carrier shafts 620, 621,622. Thus, in the case of normal rotation of the first, second and third carrier shafts 620, 621 and 62, it is preferable for the transference of the solid processing solutions to place the shooters 609–611 at the right hand side of the shafts.

Further, where the non-screwed shaft portions outside of the screw portions 620*a*–622*a* around the shooters 609–611 are so modified as to have large frictional resistance against solid processing solutions J, by for example knurling them, that can facilitate the change of direction for the solid processing solutions to move and the movement toward the shooters 609–611.

The first carrier shaft 620, the second carrier shaft 621 and the third carrier shaft 622 are connected to a drive shaft 642 of a drive motor 641 through a gear train 640. A driving power from the drive motor 641 is transmitted to the carrier shafts 620–622 through the gear train 640 to rotate the carrier shafts 620–622 in association with each other in the same direction.

Limit switches 650–652 are respectively arranged on the lids 605, 606, 607 before the shooters 609–611. When solid processing solutions J pass through with their contacting with contactors of the switches, the limit switches 650–652 turn on.

The limit switches 650–652 form a solid processing solution detecting sensor. A detecting signal from the limit switches 650–652 enables operation of the drive motor 641 to be controlled via the controlling section 22, as shown in FIG. 16.

Next, operation of the solid processing solution transferring section 60 will be described with reference to the flowchart of FIG. 21. At step (a), the solid processing solution supplying section 40 operates and solid processing solutions J are supplied from the supply opening 608. Then, at step (b), the drive motor 641 starts to rotate and the driving power of the motor is transmitted to the first carrier shaft 620, the second carrier shaft 621 and the third carrier shaft 622 to be rotated in association, whereby the solid processing solutions J are transferred with their held in roots of the screwed portions of the carrier shafts. At step (c), detection of the solid processing solutions J is made by the limit switches 650–652, and at step (d), determination on expiration of a predetermined time interval is made. The term of expiration of a predetermined time interval used herein refers to the fixed time interval counting from the very moment a solid processing solution J has been supplied (which is set longer than the time interval required for the solid processing solution J to be carried and thrown in). It is common that before the expiration of the predetermined time interval, the solid processing solutions J are detected by the limit switches 650–652, and after the detection of the solid processing solutions J until the expiration of the predetermined time interval the drive motor 641 is driven. Then, the solid processing solutions J are shifted from the non-screwed portions of the carrier shafts with rotation of the shafts and then are dropped into the related dissolving tanks 70. The drive motor 641 is stopped (at step (e)) after the expiration of the predetermined time interval after the solid processing solutions J pass through the limit switches 650–652.

If, at step (d), the solid processing solutions J are not detected even after the expiration of the predetermined time interval, that means for example that a solid processing solution J may be plugged in the carriage path in the box frame 600 or be reduced to powder. In this case, at step (g) an alarm about an abnormal feeding is given by for example sounding an alarm indicating the passage failure, and then the operation goes to step (f) to stop the drive of the drive motor 641.

Thus, even where the solid processing solution supplying section 40 is arranged at a location different from the location of the processing tanks 24 and the dissolving tanks 70 and over those tanks, the solid processing solutions J supplied by the solid processing solution supplying section 40 are allowed to be surely transferred axially to specified positions, while they are rotating, by rotation of the helical carrier shafts 620, 621, 622 of the solid processing solution transferring section 60.

Further, the transfer of the solid processing solutions J in the solid processing solution transferring section 60 can be effected with the simple and compact structure using the rotation of the screwed portions 620*a*–622*a* of the helical carrier shafts 620–622 disposed in the defined rooms K1–K3.

In addition, the transfer of the solid processing solution J in the axial direction, which is effected by the rotation of the helical carrier shafts 620–622, is restricted and is shifted in a direction different from the axial direction with the rotation of the helical carrier shafts 620–622. Thus, the shift of the transferring direction can be effected with the simple structure using the rotation of the helical carrier shafts 620–622, thus facilitating and ensuring the supply of the solid processing solutions toward the processing tanks.

Also, parts of the members defining the defined rooms K1–K3 are so arrayed that they can be removed in a longitudinal direction, and the solid processing solution transferring section 60 can be disassembled for easy maintenance. If there is a harm in transferring solid processing solutions J, the solid processing solution transferring section 60 can be taken out as a unit from the automatic developing machine by simply removing for example two face nuts. And, the removed solid processing solution transferring section 60 can be disassembled into each individual helical carrier shaft 620–622 and the box frame for clean-ups by removing the gear train 640 and then thrusting the helical carrier shafts 620–622 into the supply opening 608.

Further, the box frame 600, the partition walls 601 and the lids 605–607 are formed of substantially transparent synthetic resins, while also at least one part of the members defining the defined rooms K1–K3 are formed of substantially transparent materials. Accordingly, the location of the hitched or clogged solid processing solution J can be easily inspected from the outside. In addition, the adhesion state of the powdered or shattered solid processing solution J can also be inspected. Thus, those parts can be cleaned easily and speedily. Also, the box frame 600, the partition walls 601 and the lids 605–607 formed of substantially transparent materials can facilitate a cleaning of powdered or shattered solid processing solution J.

Figure 22:
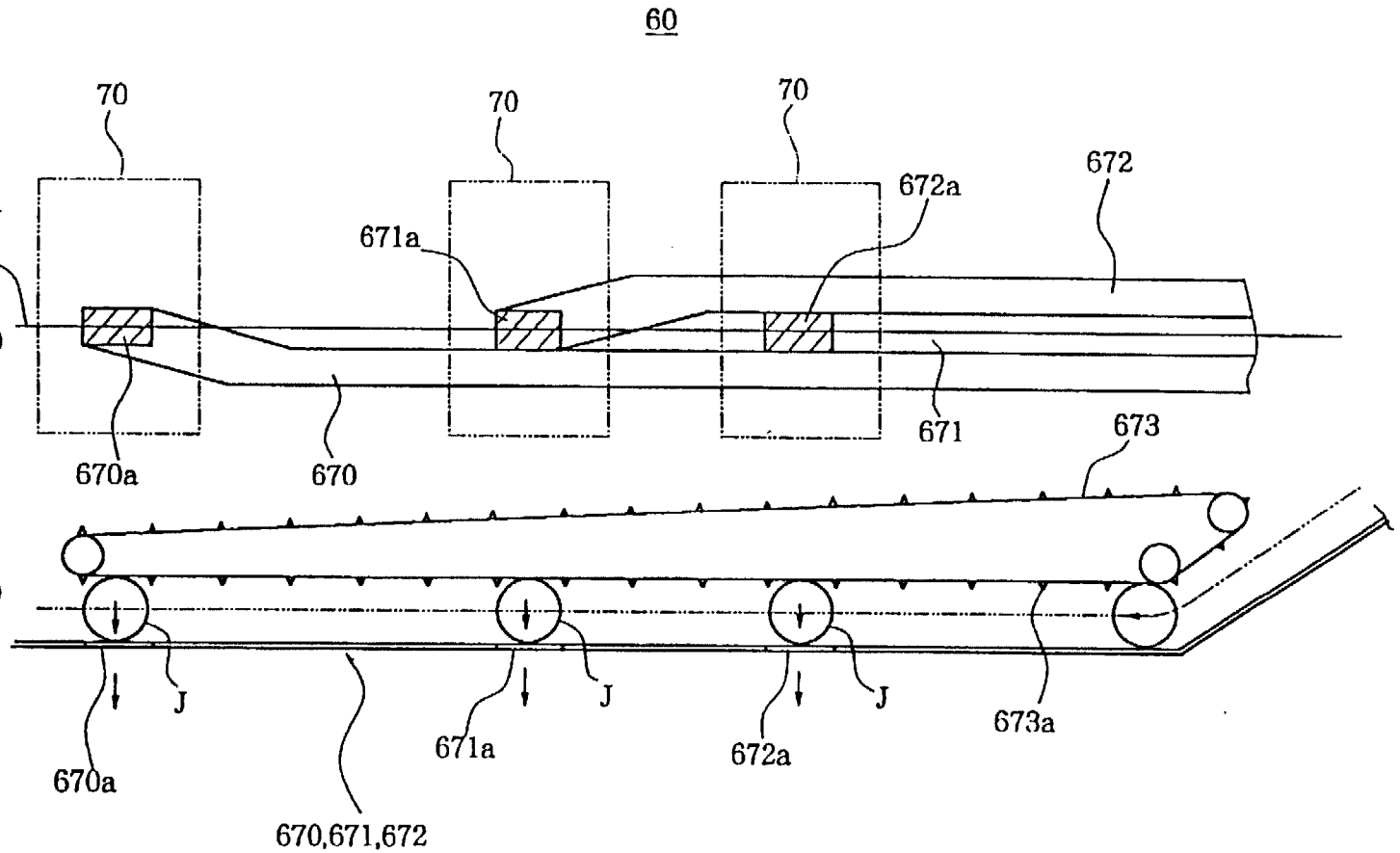
FIGS. 22(*a*) and 22(*b*) are explanatory views of a variant of the solid processing solution transferring section;.

A variant of the solid processing solution transferring section 60 will be described with reference to FIGS. 22(*a*) and 22(*b*) FIG. 22 (*a*) is a side elevation view of the solid processing solution transferring section, and FIG. 22(*b*) is a plan view of the track at the solid processing solution transferring section. In this variant, the solid processing solutions J delivered from the solid processing solution supplying section 40 are supplied onto the tracks 670–672. On the tracks 670–672 supply openings 670*a*–672*a* are formed along a line L1. The solid processing solutions J are dropped down into their related dissolving tanks 70 from the supply openings 670*a*–672*a*. The solid processing solutions J supplied from the solid processing solution supplying section 40 are held by the tracks 670–672 so that they can roll along the tracks. The solid processing solutions J are carried via an endless belt 673 having widthwise extending projections 673*a* spaced with constant intervals. The projections 673*a* of the endless belt 673 have pitches each enough for a top part of the solid processing solution J to be held. The endless belt 673 is formed of flexible material such as rubber or resin so that they cannot damage the solid processing solutions J in transference and can ensure the transference. The endless belt 673 forms a carriage means, having uniform pitches and endless in motion, for allowing the solid processing solutions J on the tracks 670–672 to be smoothly and surely transferred along the tracks 670–672.

Figures 23A, 23B:
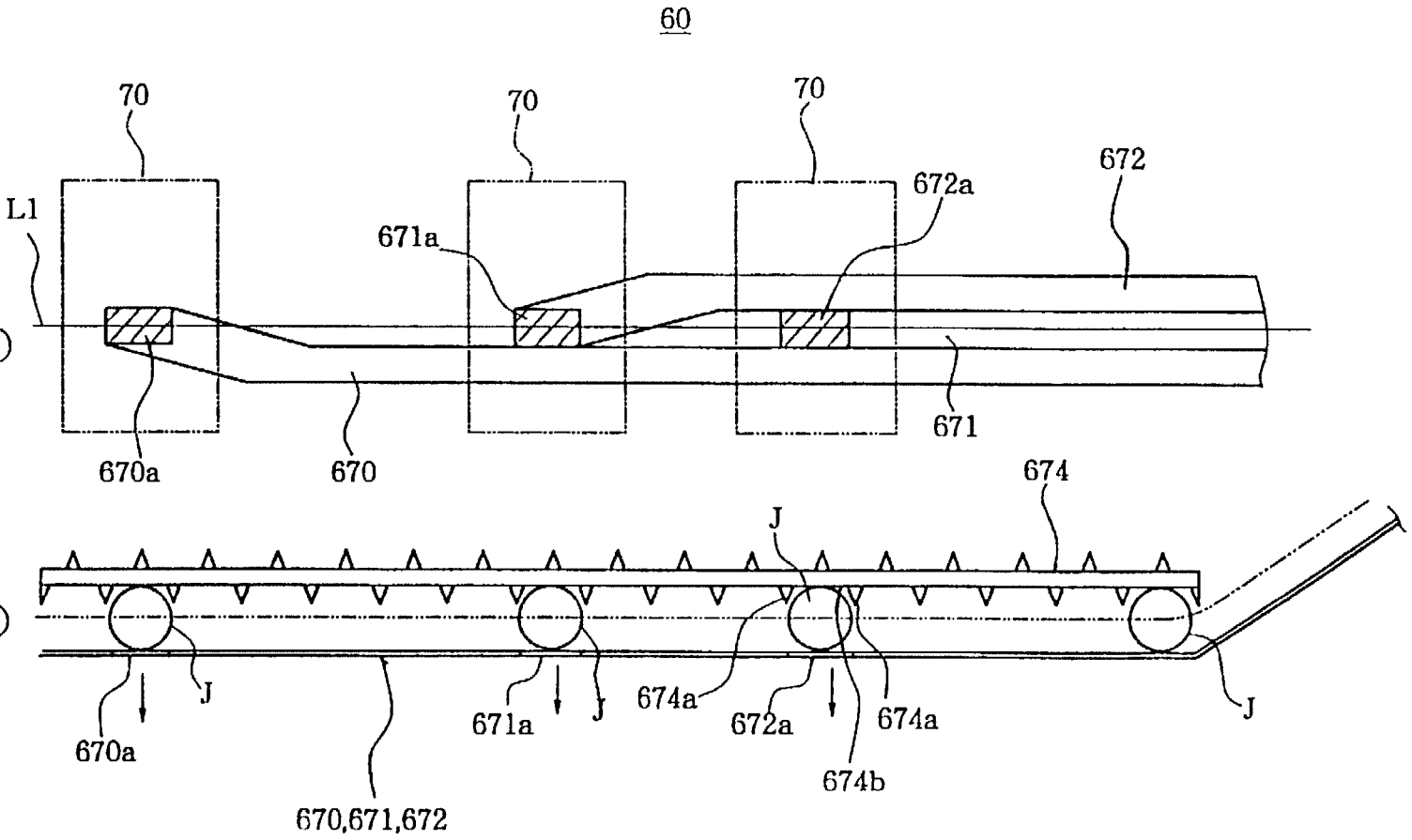
FIGS. 23(*a*) and 23(*b*) are views of another variant of the solid processing solution transferring section.

Another variant of the solid processing solution transferring section 60 will be described with reference to FIGS. 23(*a*) and 23(*b*) FIG. 23(*a*) is a side elevation view of the solid processing solution transferring section, and FIG. 23(*b*) is a plan view of the track at the solid processing solution transferring section. This variant is identical in construction to the immediately above-mentioned embodiment, except for a helical carrier shaft 674 used in place of the endless belt 673. Rotation of the helical carrier shaft 674 allows the solid processing solutions J to be transferred rolling along the track, with their top parts held by roots 674*b* between adjacent screwed parts 674*a* of the helical carrier shaft.

Figure 24:
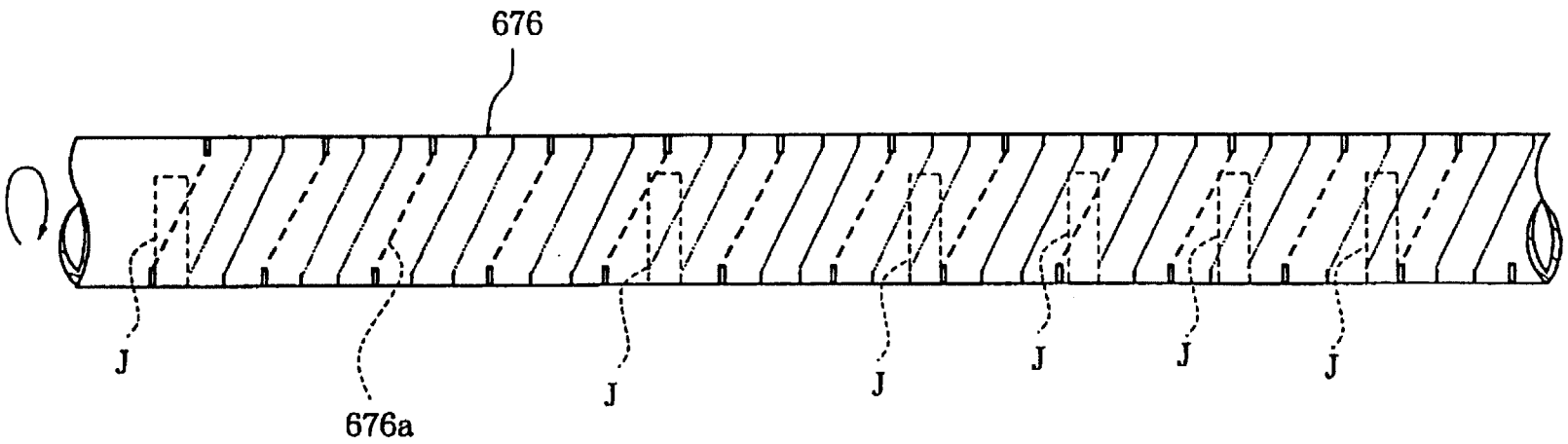
FIG. 24 is a yet another variant of the solid processing solution transferring section.

A yet another variant of the solid processing solution transferring section 60 will be described with reference to FIG. 24. FIG. 24 is a side elevation view of the solid processing solution transferring section. This variant uses a cylinder 676 able to rotate and having three screw threads 676*a* on its interior wall. Rotation of the cylinder allows the solid processing solutions J supplied in the cylinder to be transferred by the three screw threads 676*a* rolling therealong. It will be appreciated that the number of screw threads may be determined as needed, though this embodiment adopts the screw threads 676*a* of three for the transference. The cylinder 676 forms the carriage means, having uniform pitches and endless in motion, for allowing the solid processing solutions J to be transferred with simple structure.

Figure 25:
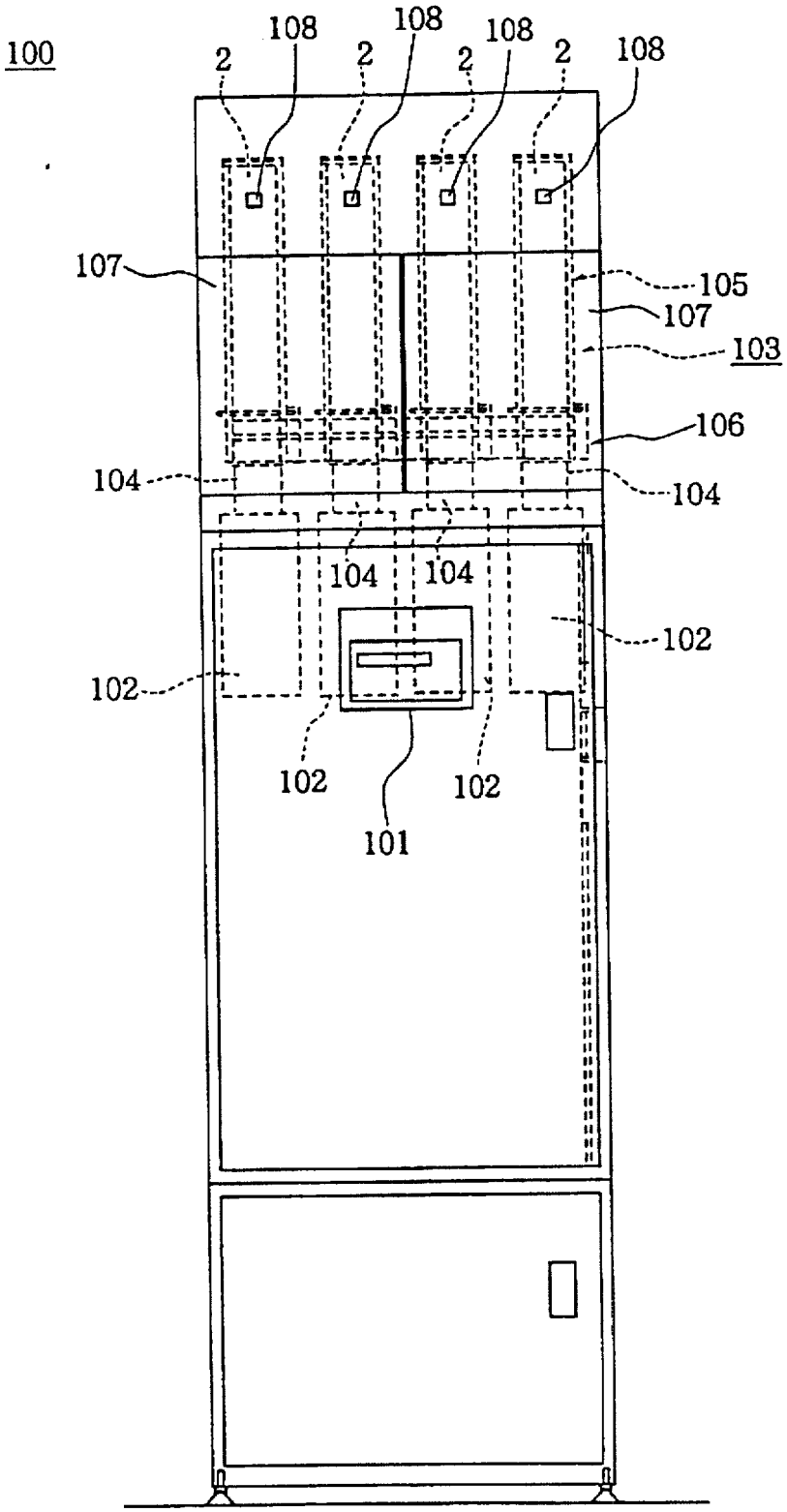
FIG. 25 is a front view of a separate-setting replenishing unit.
Figure 26:
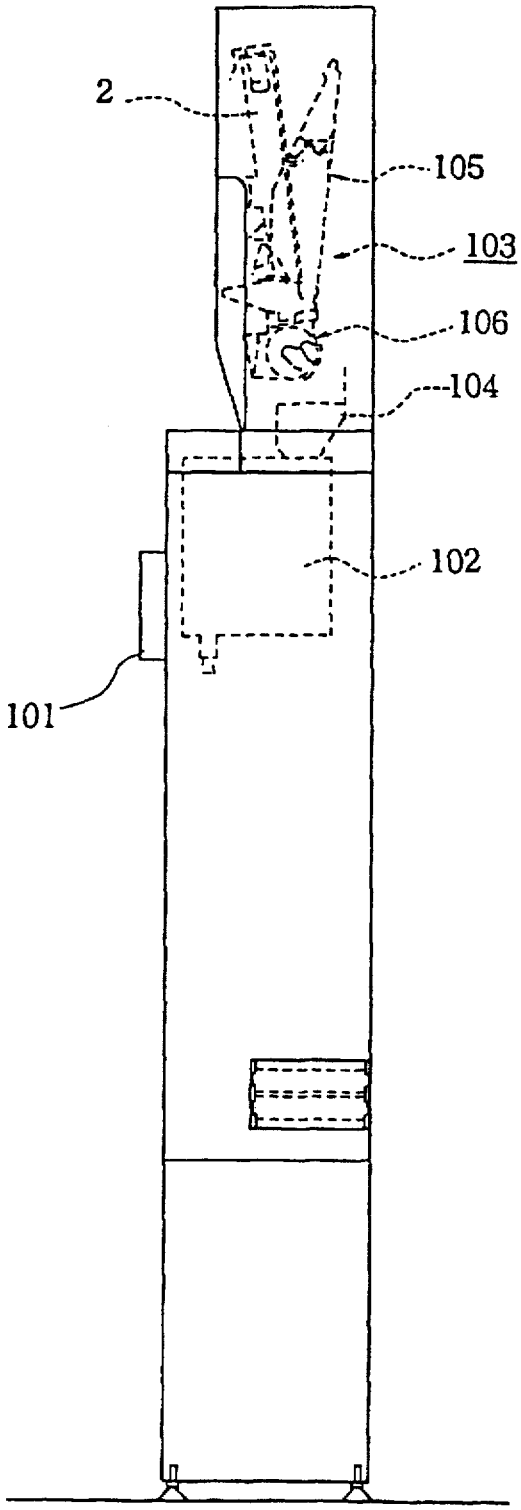
FIG. 26 a right side view of the separate-setting replenishing unit.

Next, one example of a separate-setting replenishing unit to which the invention is applicable will be described with reference to the drawing. FIG. 25 is a front view of the separate-setting replenishing unit, and FIG. 26 is a right side view of the separate-setting replenishing unit.

The separate-setting replenishing unit 100 is set separate from the automatic developing machine not shown. The separate-setting replenishing unit 100 is provided at a front portion thereof with an operating portion 101 and at the inside thereof with the dissolving tanks 102 which are placed corresponding to the processing tanks of the automatic developing machine not shown. The dissolving tanks 102 are connected to the processing tanks through circulation hose or circulating pumps not shown. In this embodiment, four dissolving tanks 102 are placed corresponding to the color development tank, the bleaching tank, the fixing tank and the stabilizing tank of the automatic negative film developing machine, though the number of the dissolving tanks is not necessarily specified.

Further, the separate-setting replenishing unit 100 is provided at an upper part thereof with a solid processing solution supplying section 103 and shooters 104 corresponding in position to the dissolving tanks 102. The solid processing solution supplying section 103 includes a loading portion 105 and a supplying portion 106. The solid processing solutions cartridge 2 containing solid processing solutions J is loaded into the loading portion 105 after a door 107 is opened. Operation indicating lamps 108 are provided corresponding in position to parts of the supplying portion 106, so that they can be switched on after the supplying portion 6 starts to act until the supply of the solid processing solutions J is terminated.

Figure 27:
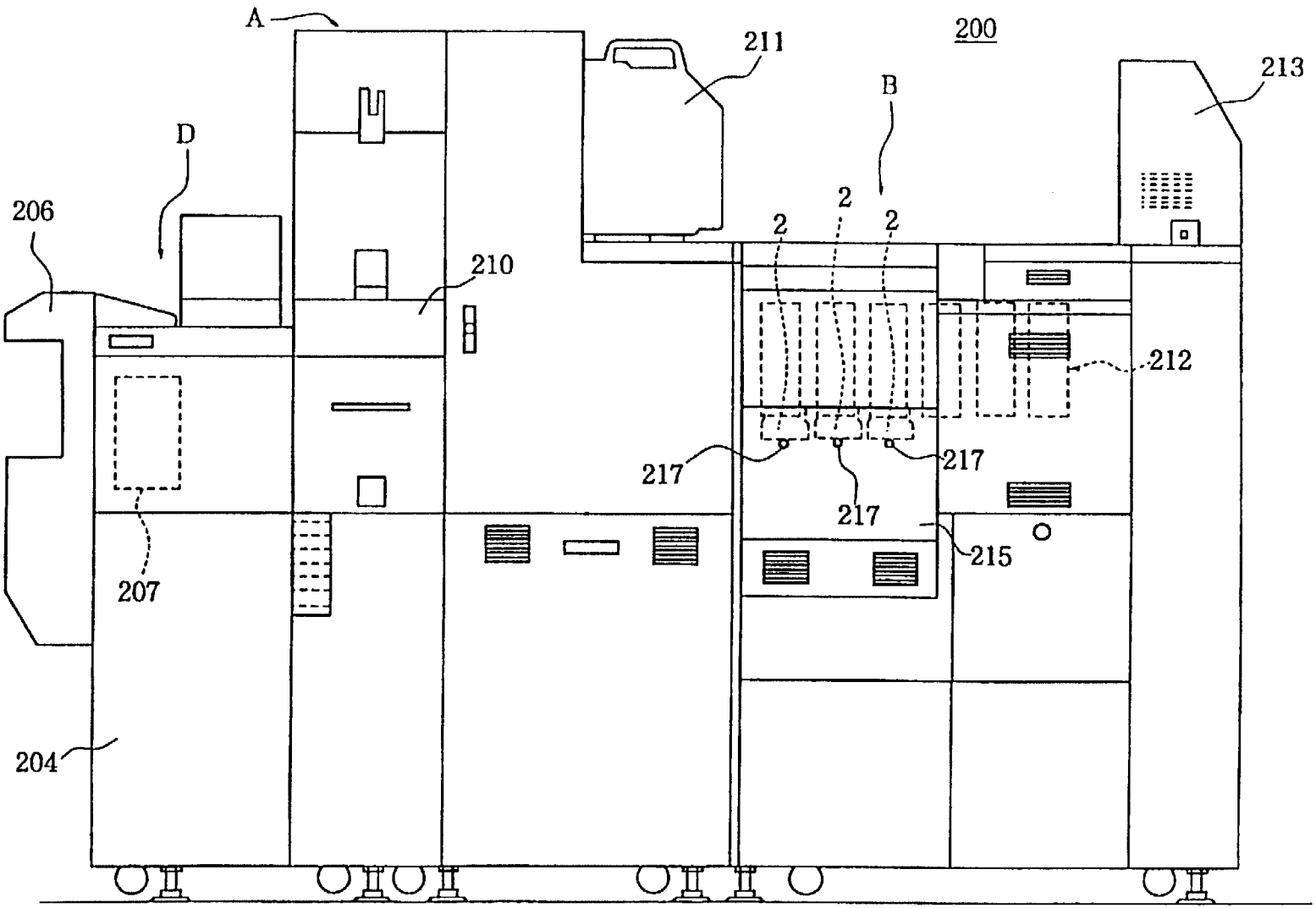
FIG. 27 is a front view of a photosensitive material developing machine to which the invention is applied.
Figure 28:
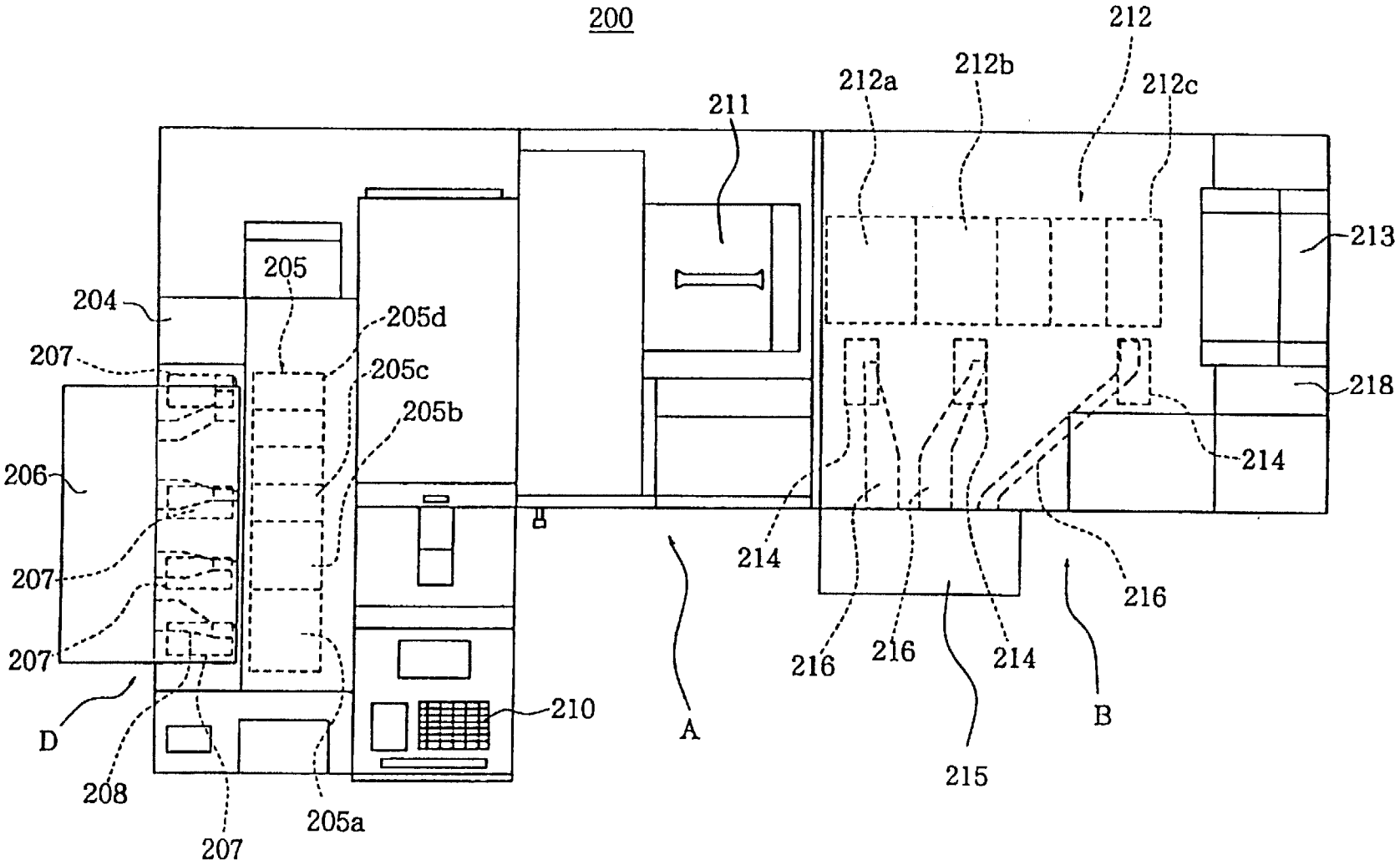
FIG. 28 is a plan view of the photosensitive material developing machine.
Figure 29:
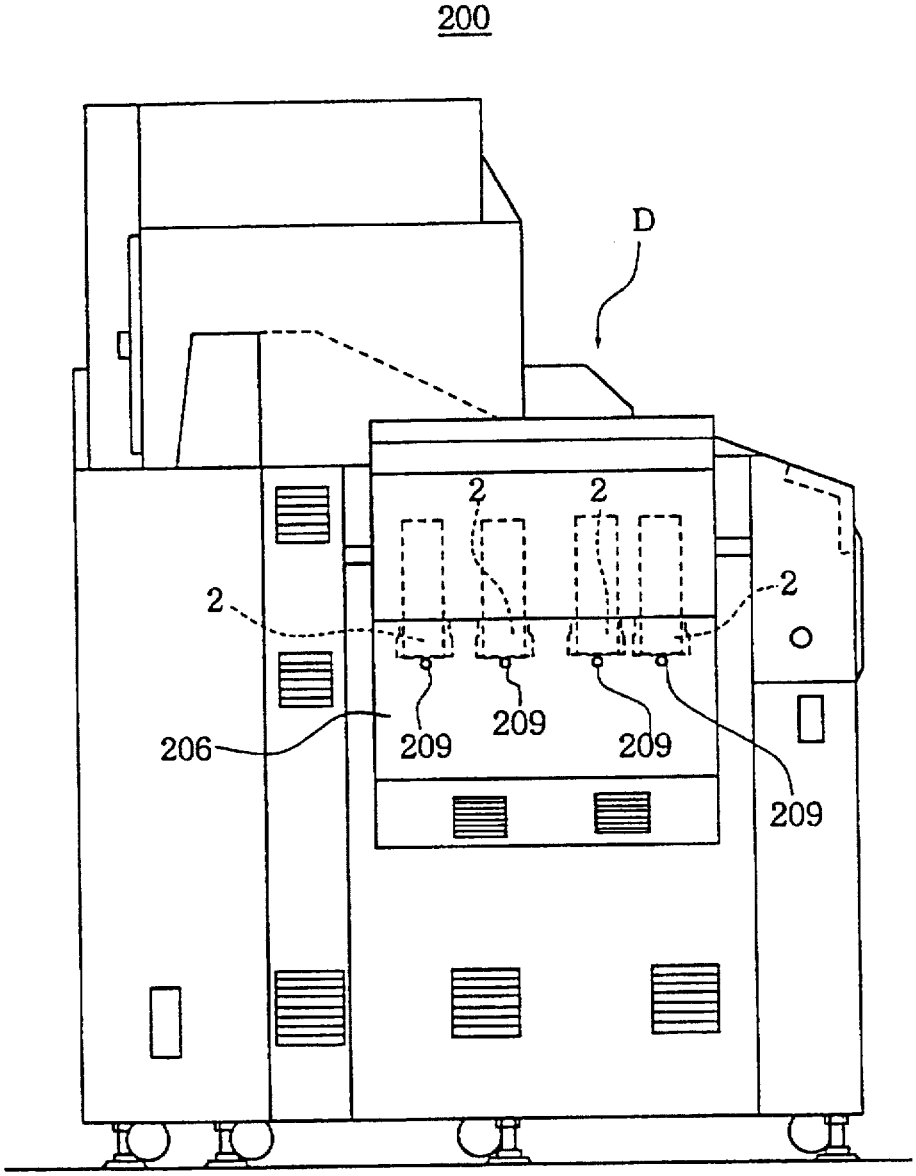
FIG. 29 is a left side view of the photosensitive material developing machine.
Figure 30:
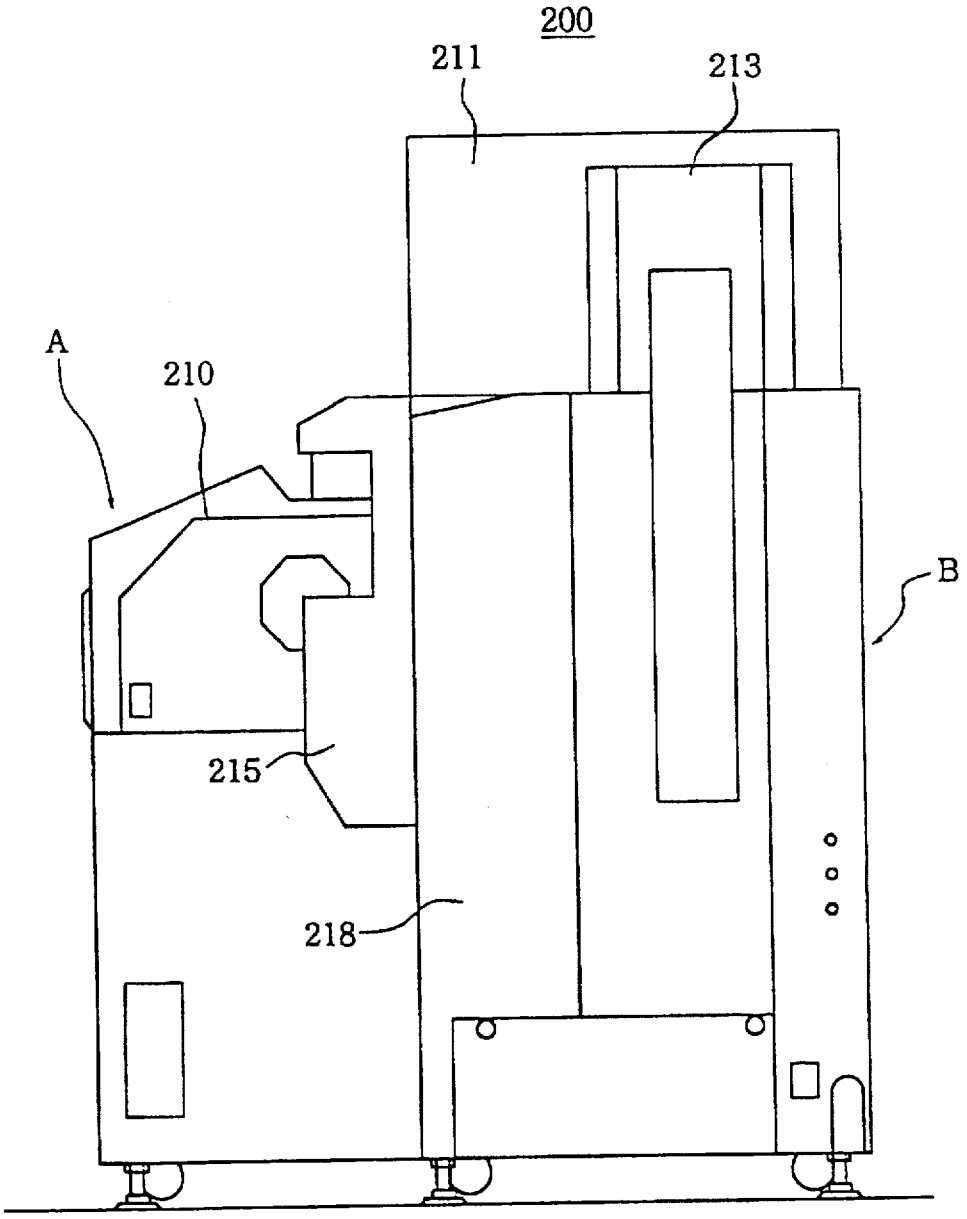
FIG. 30 is a right side view of the photosensitive material developing machine.

Next, one example of a photosensitive material developing apparatus to which the invention is applicable will be described with reference to the drawing. FIG. 27 is a front view of the photosensitive material developing apparatus; FIG. 28 is a plan view of the photosensitive material developing apparatus; FIG. 29 is a left side view of the photosensitive material developing apparatus; and FIG. 30 is a right side view of the photosensitive material developing apparatus.

The photosensitive material developing apparatus 200 comprises an automatic negative film developing machine D for developing negative films, a photo-printing machine A, and an automatic paper developing machine B which are integral with each other. The automatic negative film developing machine D is located at the left hand side. The body 204 of the automatic negative film developing machine is provided at a central portion thereof with processing tank 205 and at the left side thereof with a solid processing solution supplying section 206. The processing tank 205 is in the form of a substantially four-tier tank comprising a color development tank 205*a*, a bleaching tank 205*b*, a fixing tank 205*c* and stabilizing tank 205*d*. Dissolving tanks 207 are situated with their communicating with the associated processing tanks. The solid processing solutions are supplied to the dissolving tanks 207 from a solid processing solution supplying section 206 through shooters 208. The solid processing solution supplying section 206 is provided with operation indicating lamps 209, which are placed corresponding to their related supplying portion for the solid processing solution cartridges 2. The operation indicating lamps are switched on from a starting of the supplying action until a termination of the feeding of the solid processing solutions J.

The solid processing solution supplying section 206 is placed alongside of the automatic negative film developing machine body 204 so as not to hinder maintenance of the automatic negative film developing machine body 204. Besides, the solid processing solution supplying section 206 is vertically mounted at the outside of the automatic negative film developing machine body 204, so as to be reduced in widthwise dimension. Thus, it becomes easy to find an available space therefor. Further, the solid processing solution supplying section 206 is located alongside the automatic negative film developing machine body 204, rather than over it, so that solid processing solutions can be protected from thermal or moisture effects. Moreover, the solid processing solution supplying section 206 is positioned at substantially the same level as the operating portion 210 of the photo-printing machine A, for easy replacement of solid processing solution cartridges 2 and easy maintenance.

The photo-printing machine A is situated between the automatic negative film developing machine D and the automatic paper developing machine B. The photo-printing machine A is provided at a front portion thereof with an operating portion 210 and at an upper portion thereof with a magazine containing portion 211 in which a magazine, containing a rolled photographic paper of an unexposed silver halide photosensitive material, is set. In the photo-printing machine A, original photographic images are exposed on the printing paper drawn out of the magazine in the magazine containing portion 211 and then the exposed printing paper is introduced into the automatic paper developing machine B.

The automatic paper developing machine B comprises processing tanks 212 and a drying section 213. The printing paper is developed in the processing tank section 212 and is dried in the drying section 213, whereby photoprints are made and then are taken out. The processing tank section 212 comprises a color development tank 212*a*, a bleaching-fixing tank 212*b* and a three-tier stabilizing tank 212*c*. The printing paper are transferred through the processing tanks in order so that it can be subject to a color developing process, a bleaching and fixing process and a stabilizing process, respectively.

Dissolving tanks 214 are situated with their communicating with the color development tank 212*a*, the bleaching-fixing tank 212*b* and the stabilizing tanks 212*c*, respectively. The solid processing solutions J are supplied to the dissolving tanks 214 from a solid processing solution supplying section 215 through shooters 216. The solid processing solution supplying section 215 is provided with operation indicating lamps 217, which are placed corresponding to their related supplying portion for the solid processing solution cartridges 2, so that they are switched on from a starting of the supplying action until a termination of the feeding of the solid processing solutions J.

The solid processing solution supplying section 215 is placed at a front of the automatic developing machine body 218 so as not to hinder maintenance of the automatic developing machine body 218. In addition, the solid processing solution supplying section 215 is vertically mounted at the outside of the automatic developing machine body 218, so as to be reduced in widthwise dimension. Thus, it becomes easy to find an available space therefor. Further, the solid processing solution supplying section 215 is not located over the automatic developing machine body 218, so that solid processing solutions J can be protected from thermal or moisture effects. Moreover, the solid processing solution supplying section 215 is positioned at substantially the same level as the operating portion 210 of the photo-developing machine 202, for easy replacement of solid processing solution cartridges 2 and easy maintenance.

It is noted that the solid processing solution supplying section 206 provided in the automatic negative film developing machine D and the solid processing solution supplying section 215 provided in the automatic paper developing machine B both have the same construction. For convenience's sake, only reference to the solid processing solution supplying section 215 provided in the automatic paper developing machine B is given here with reference to FIG. 25 through FIG. 34.

Figure 31:
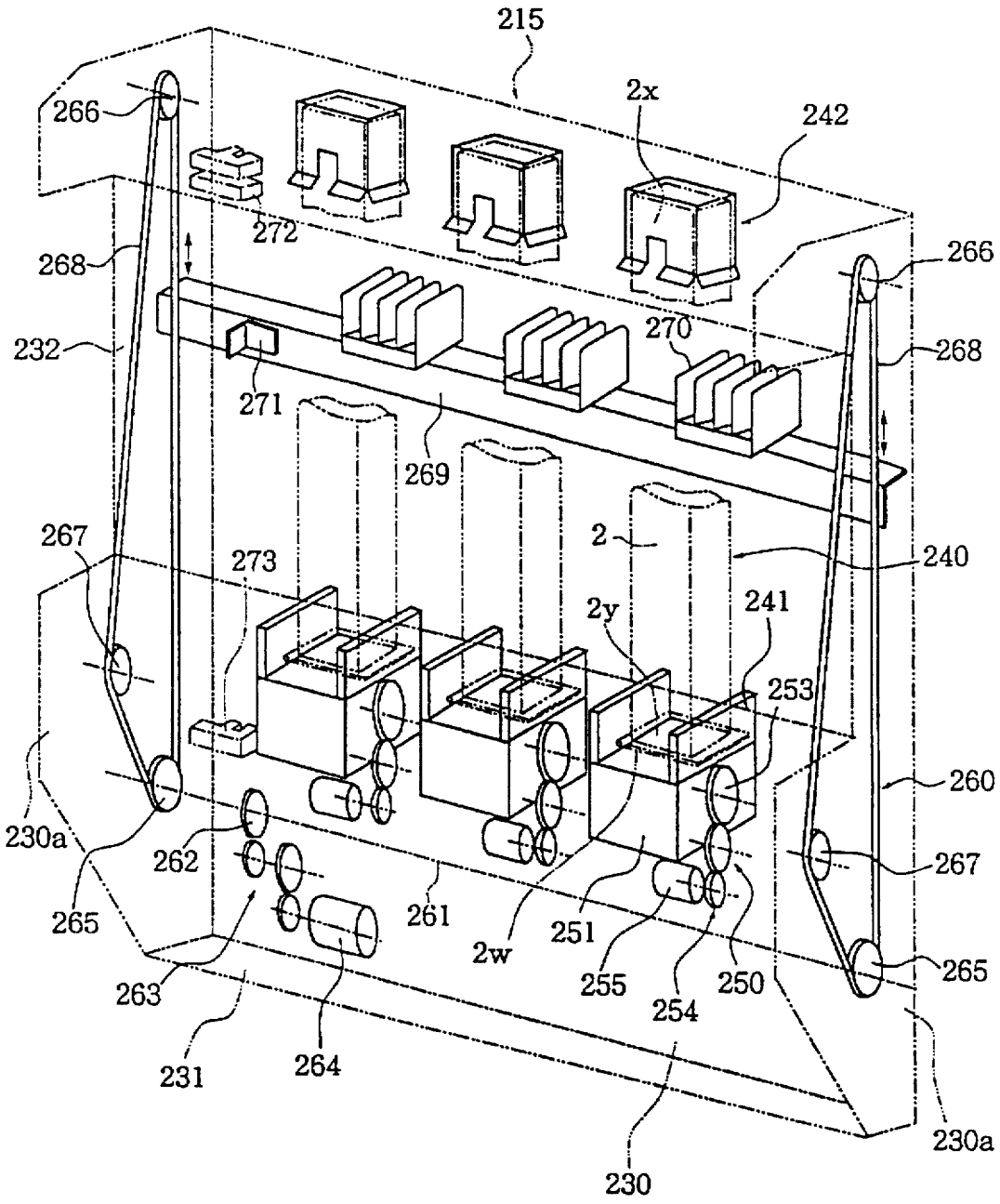
FIG. 31 is a perspective view of a rough arrangement of a supplying portion of the solid processing solution supplying section.
Figure 32:
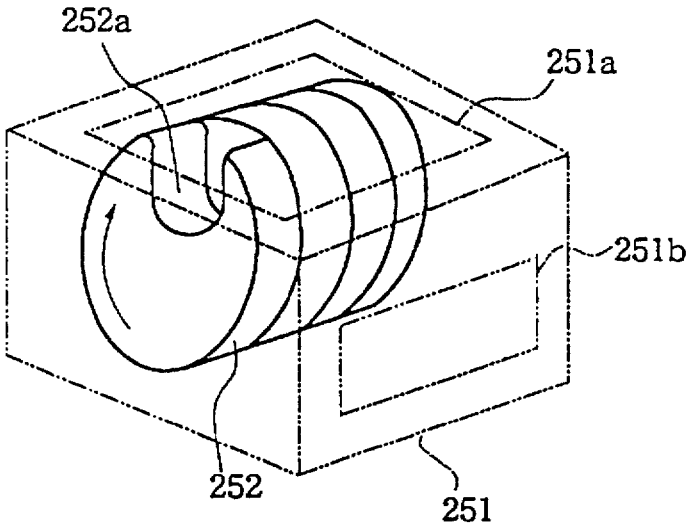
FIG. 32 is a perspective view of the supplying portion of the solid processing solution supplying section.
Figure 33:
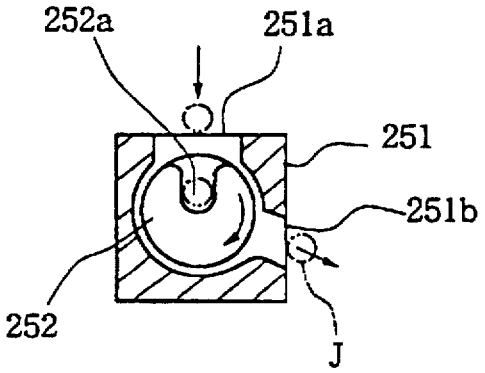
FIG. 33 is a sectional view of the supplying part of the solid processing solution supplying section.
Figure 34:
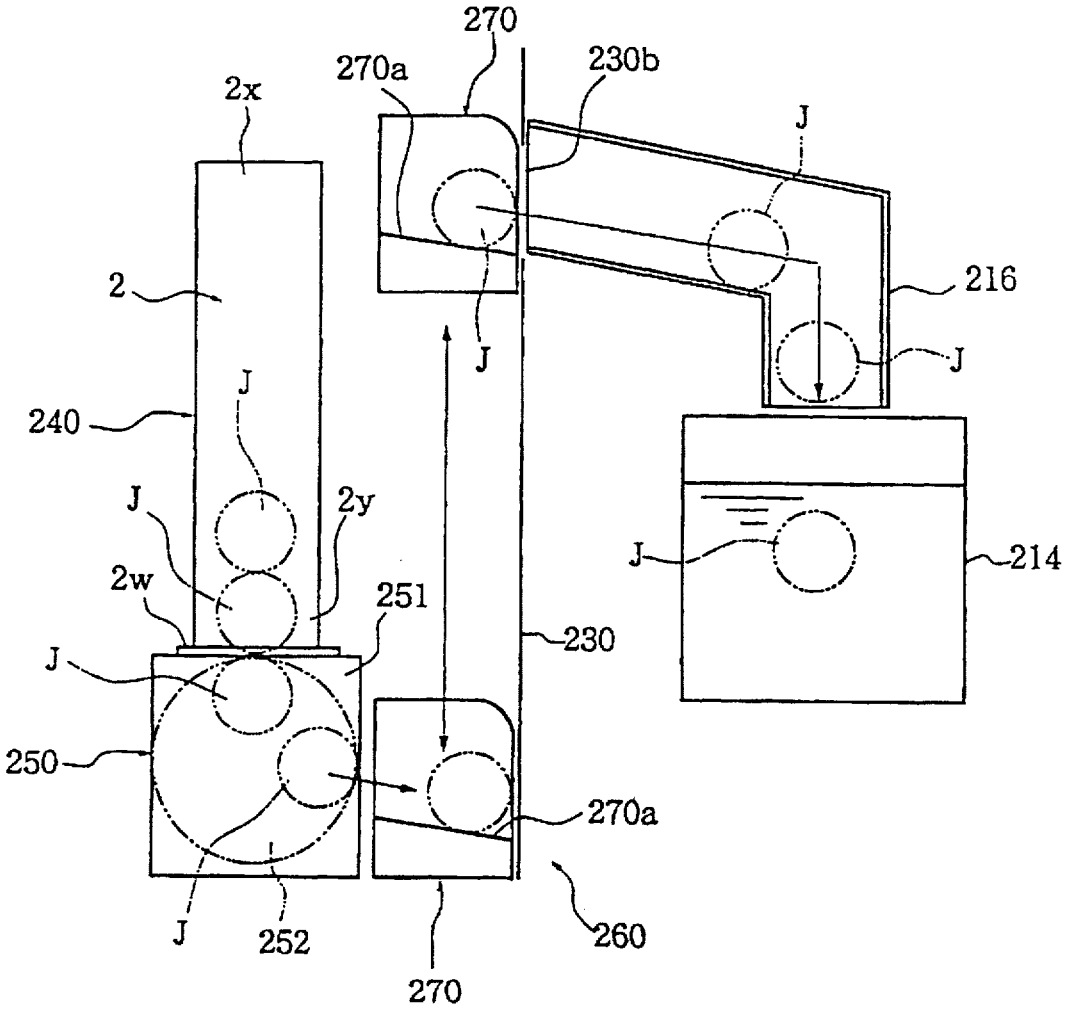
FIG. 34 is a schematic diagram illustrating a supply in the solid processing solution supplying section.
Figure 35:
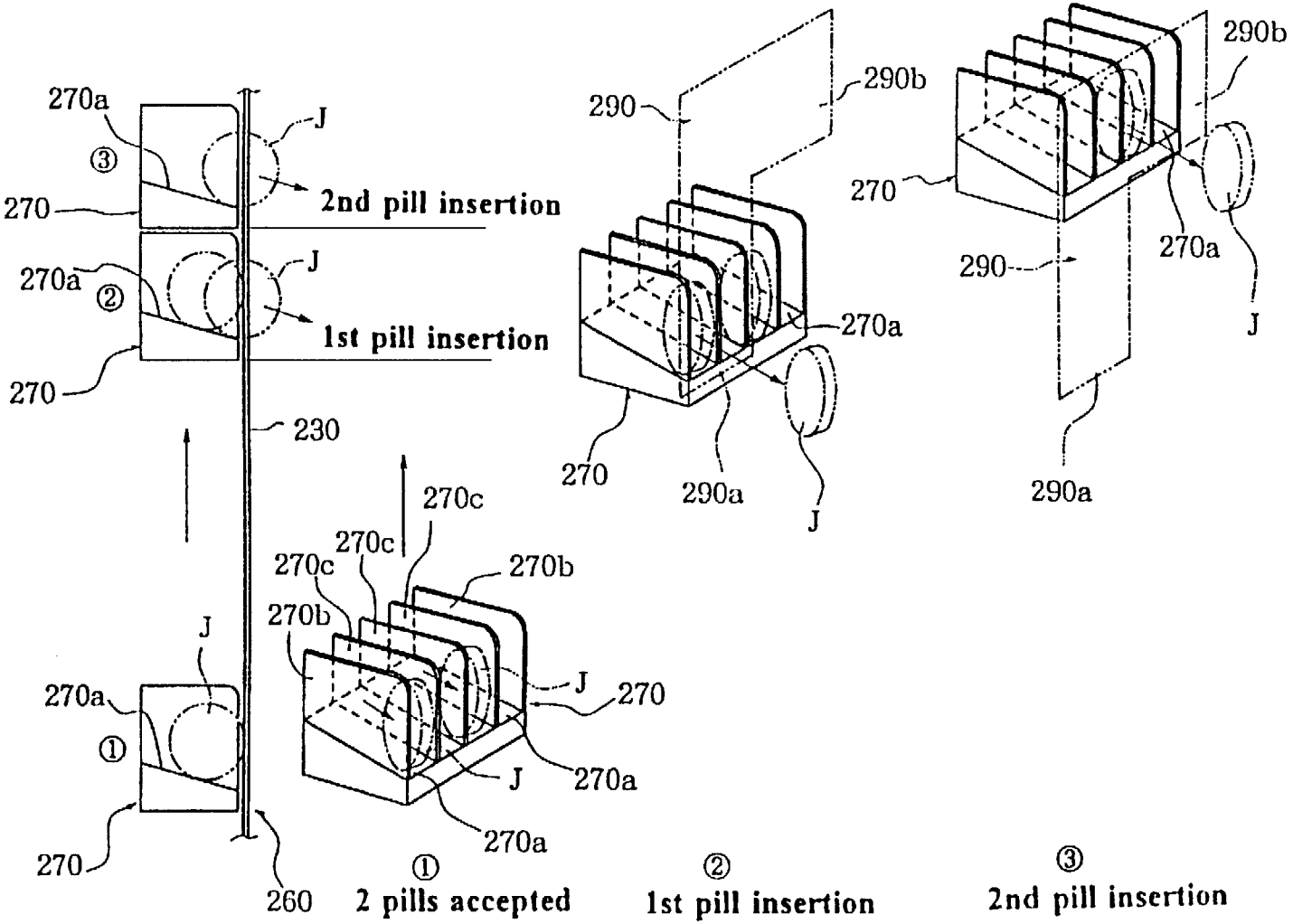
FIG. 35 is an illustration of an example for supply of two tablets of solid processing solutions.
Figure 36A:
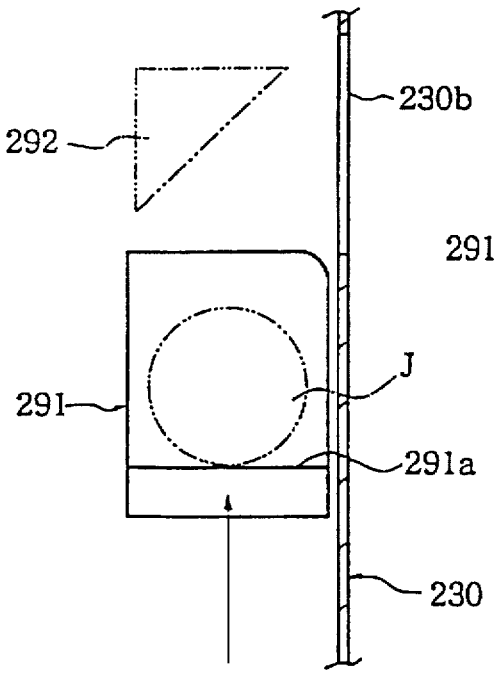
FIGS. 36(*a*) and 36(*b*) are illustrations of a modified bucket.
Figure 36B:
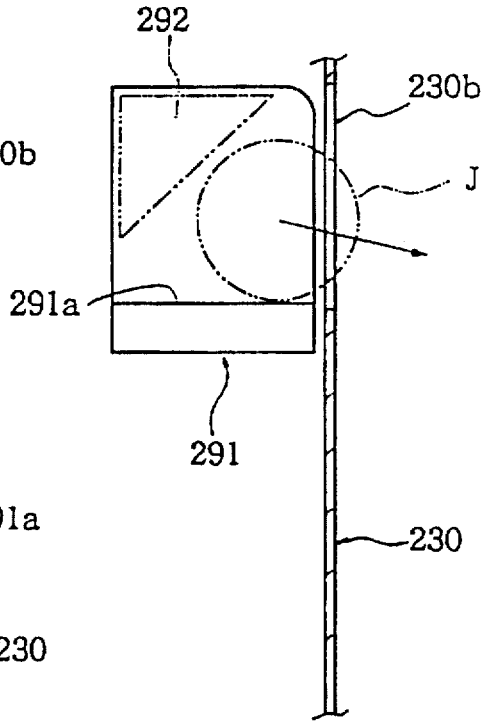
Figure 37A:
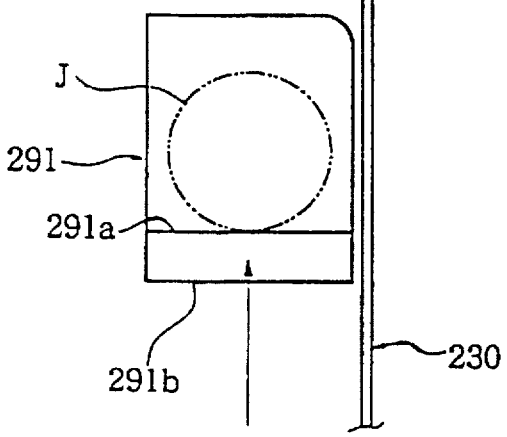
FIGS. 37(*a*) and 37(*b*) are illustrations of a further modified bucket.
Figure 37B:
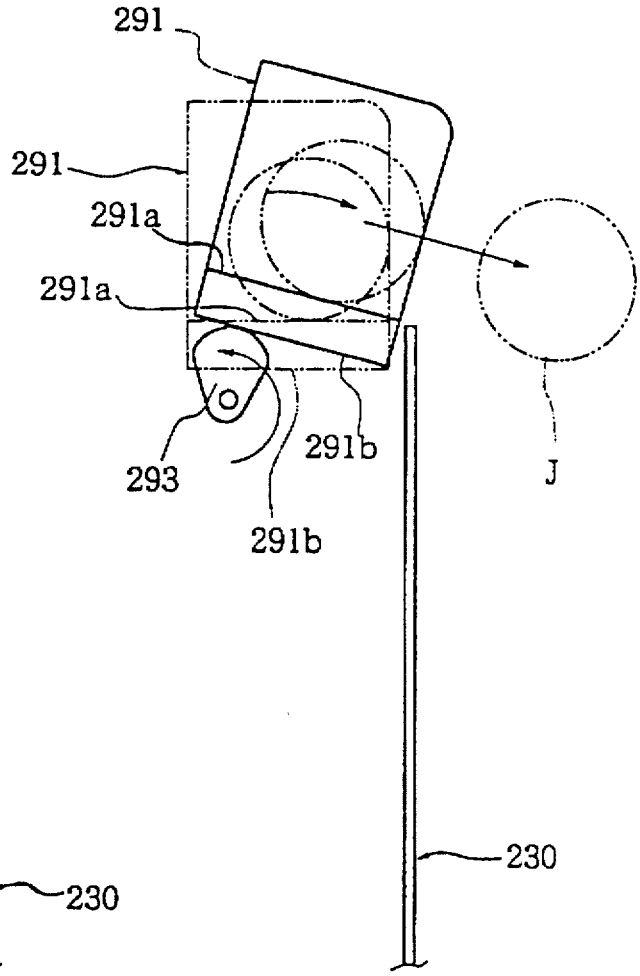
Figure 38:
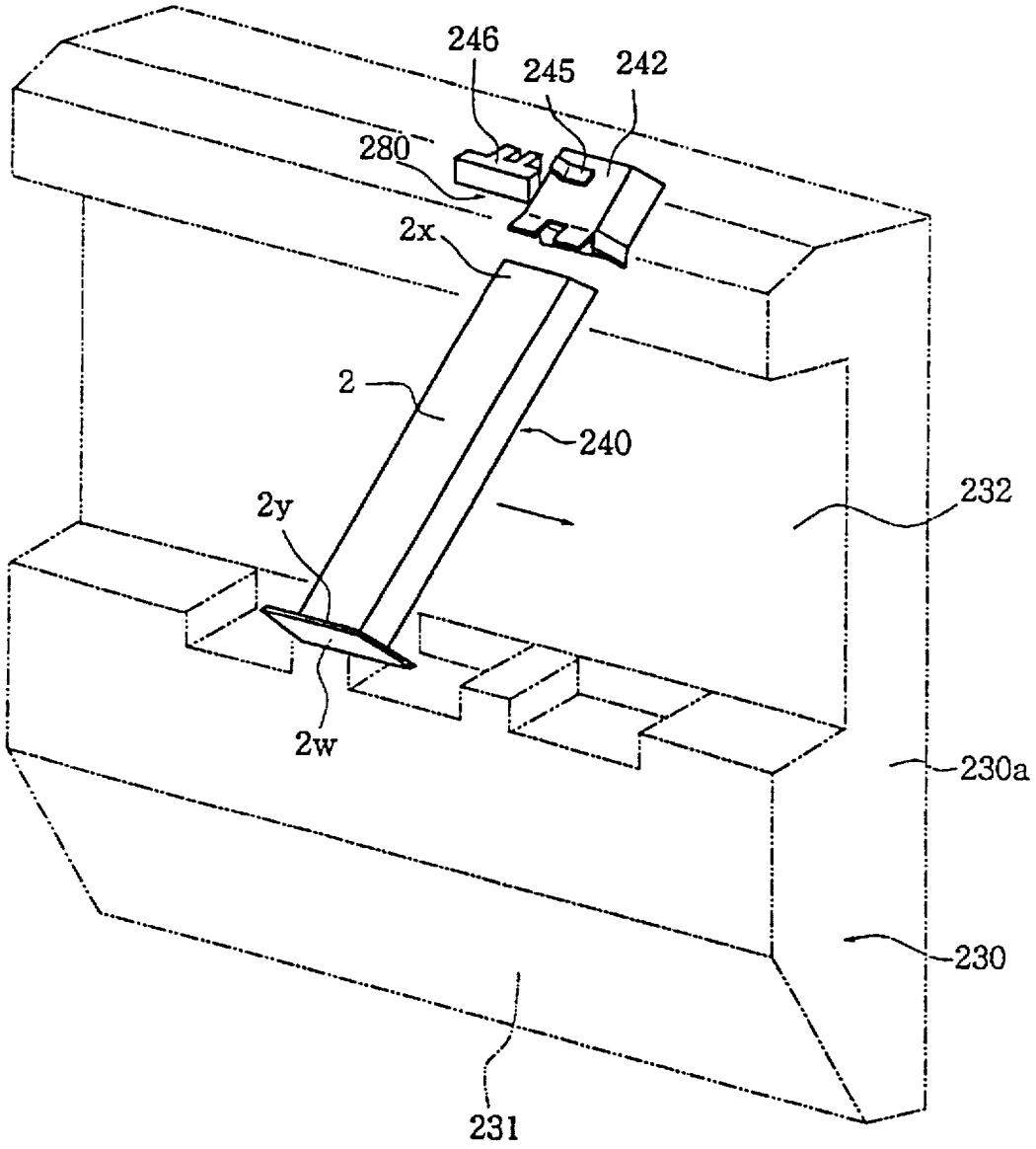
FIG. 38 is a perspective view of a solid processing solution cartridge in a setting condition.
Figure 39:
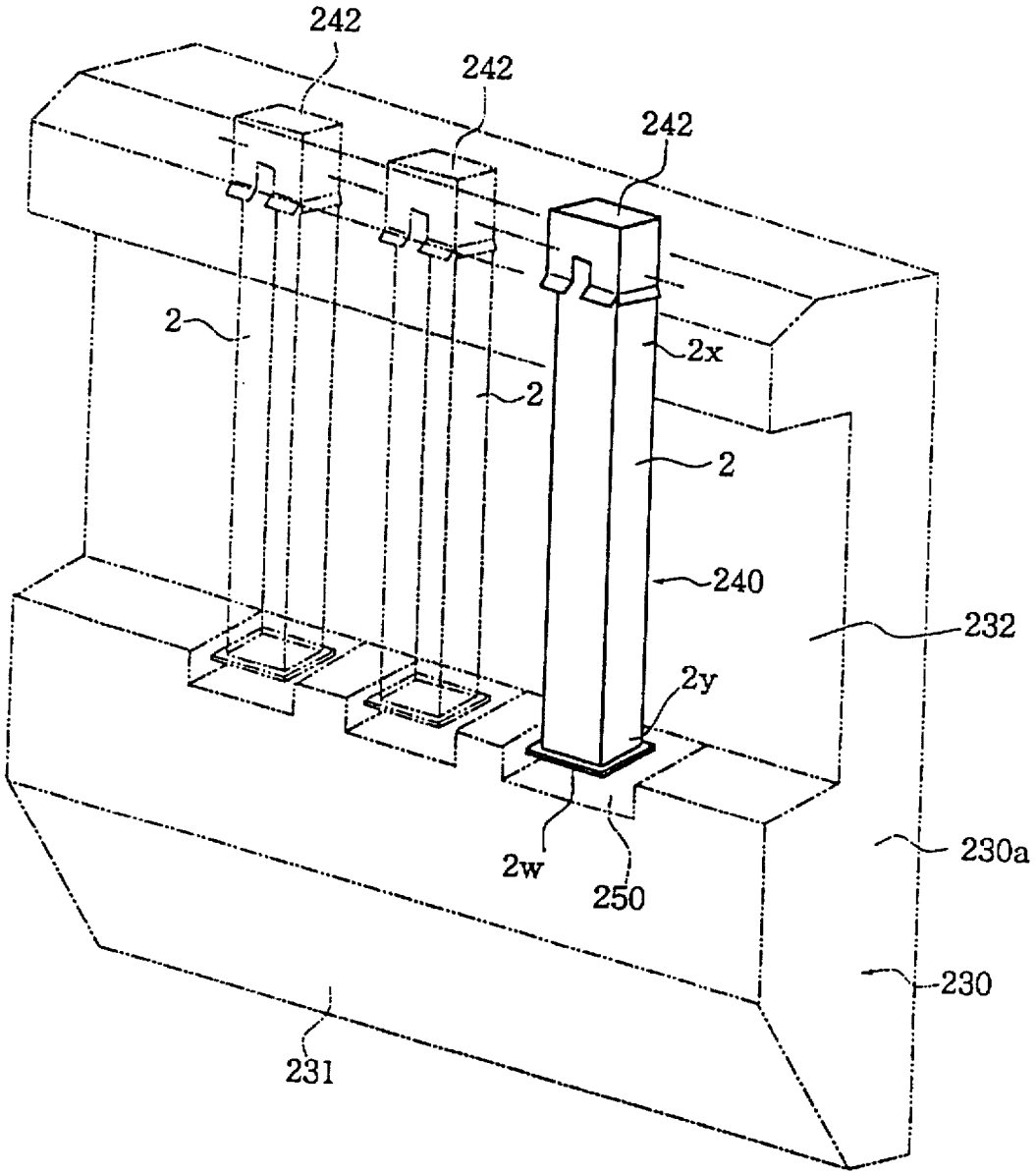
FIG. 39 is a perspective view of the solid processing solution cartridge as set in place.
Figure 40:
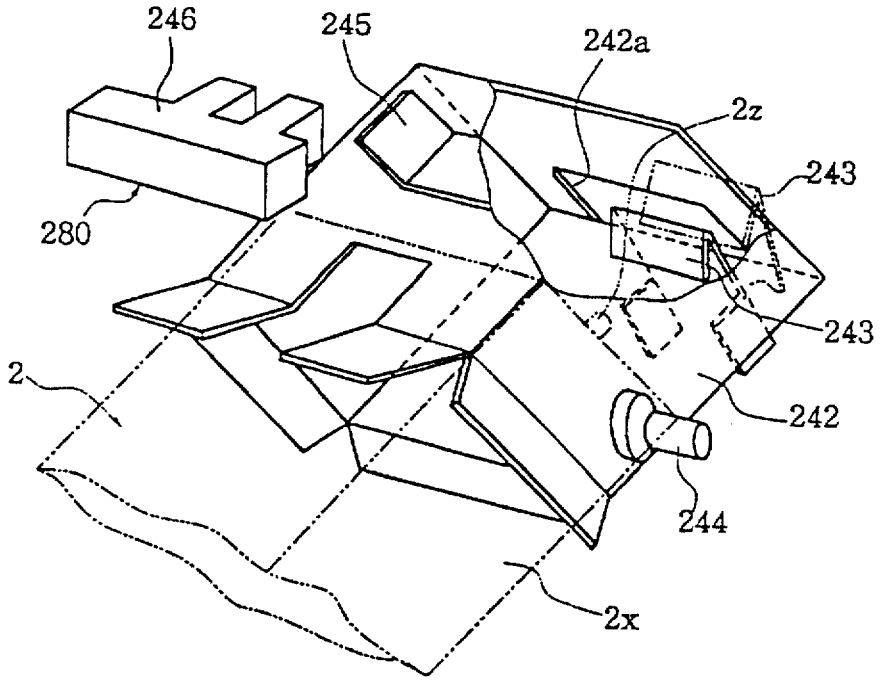
FIGS. 40(*a*) and (*b*) are perspective views showing the solid processing solution cartridge in a sensing condition.
Figure 40:
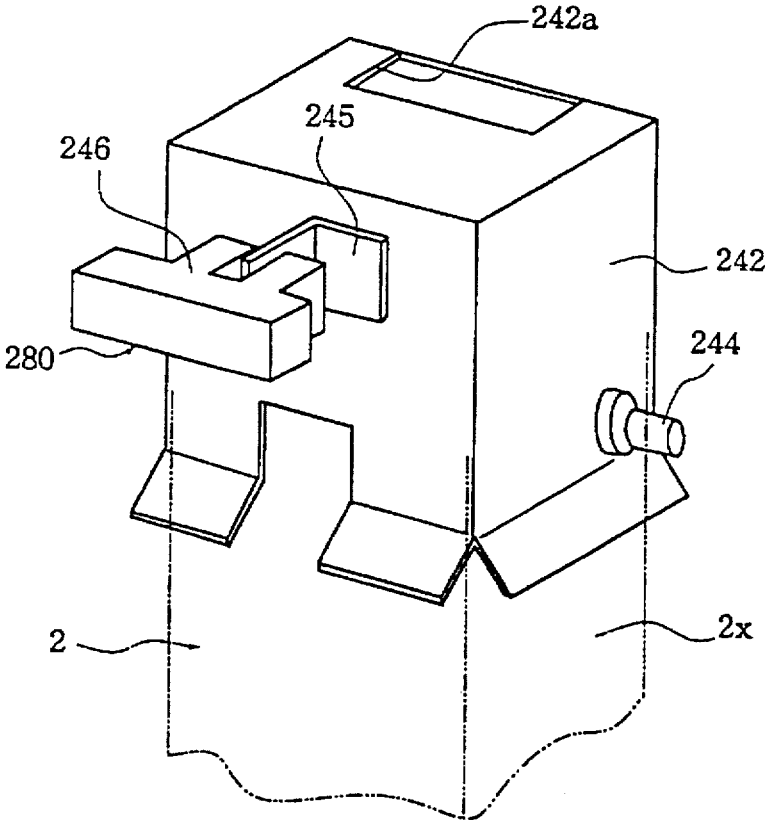

FIG. 31 is a perspective view of a rough arrangement of the supplying portion of the solid processing solution supplying section; FIG. 32 is a perspective view of the supplying portion of the solid processing solution supplying section; FIG. 33 is a sectional view of the supplying portion of the solid processing solution supplying section; FIG. 34 is a schematic diagram illustrating a supply in the solid processing solution supplying section; FIG. 35 is an illustration of an example for supply of two tablets of solid processing solutions; FIG. 36 is an illustration of a modification of bucket; FIG. 37 is another modification of bucket; FIG. 38 is a perspective view of a solid processing solution cartridge in a setting condition; FIG. 39 is a perspective view of the solid processing solution cartridge as set in place; and FIG. 40 is a perspective view showing the solid processing solution cartridge in a sensing condition.

The solid processing solution supplying section 215 includes a loading portion 240, a supplying portion 250 and the solid processing solutions transferring portion 260, which are housed in the room defined by a cover 230, and a front cover 231 and an opening cover 232 both covering the cover 230, with their corresponding in position to the dissolving tanks 214. The loading portion 240 includes a cartridge platform 241 provided at a lower part of the cover 230 and a cartridge holder 242 provided at an upper part of the cover 230. The top 2*x* of the solid processing solution cartridge 2 is inserted into the cartridge holder 242 from below toward above and then an opening end 2*y* of the same is placed in position on the cartridge platform 241, whereby the setting of the cartridge is made.

The supplying portion 250 is constituted, as illustrated in FIGS. 32 and 33, such that a plurality of rotors 252 are held in rotor cases 251 so that they can rotate. Each rotor case 251 has a solid processing solution inlet 251*a* at the top end. Solid processing solutions J contained in each of the cartridges cannot be dropped from the solid processing solution inlet 251*a* until a sliding lid 2*w* of the each solid processing solution cartridge 2 is opened. Each solid processing solution J is dropped and held in a cavity 252*a* of each of the rotors 252 when the cavity 252*a* is in its top position. With rotation of the rotor 252, the solid processing solution J held by rotor is moved to a supply opening 251*b* and is fed therefrom into the solid processing solution transferring portion 260.

After the solid processing solution J is discharged from the cavity 252*a* of the rotor 252, the rotor 252 is reversed so that the cavity 252*a* can return to its initial position to receive a next solid processing solution J in it. A driving gear 253 for the rotor 252 is connected to a supplying motor 255 through a gear train 254, so that the rotor 252 is rotated by the supplying motor 255.

The solid processing solution transferring portion 260 includes a driving shaft 261 which is rotatably supported by opposite sides 230*a* of the cover 230 and to which a driving gear 262 is fixed. The driving gear 262 is connected to an elevating motor 264 through a gear train 263. The driving shaft 261 is rotated in association with a normal rotation or a reverse rotation of the elevating motor 264. A lower sprocket 265 is fixed to each end of the driving shaft 261. Among the lower sprocket 265, and an upper sprocket 266 and an intermediate sprockets 267, both journaled at each side 230*a* of the cover 230, is stretched an elevating chain 268. An elevating frame 269 is provided between the elevating chains 268, and mounts buckets 270 on it.

Further, the elevating frame 269 is provided with a sensor plate 271. An upper limit sensor 272 is set at a position over the sensor plate and an lower limit sensor 273 is set at a position under the sensor plate. Even if a signal to make an additional supply of solid processing solutions J is issued when replenishment of solid processing solutions J is under operation, the rotors 252 are not turned, unless the lower limit sensor 273 detects the sensor plate 271 or unless the buckets 270 are in their lower position. After completion of the supply of the solid processing solutions, when the buckets 270 are lowered by the elevating motor 264 down to a position at which the sensor plate 271 can be detected by the lower limit sensor 273, the supplying motor 255 is rotated to set a solid processing solutions J in the buckets 270 from the rotors 252.

Like this, the buckets 270, through which the solid processing solutions J are supplied into the dissolving tanks 214 for the processing tanks 212 comprising the color development tank 212*a*, bleaching-fixing tank 212*b* and stabilizing tank 212*c*, are mounted on the single elevating frame 269. The elevating frame 269 is raised or lowered by drive of the single elevating motor 264. For replenishment of a single solution tank, e.g., the color developing tank 212*a*, with solid processing solutions J, the solid processing solutions J are contained in the bucket related to the color developing tank 212*a* and then are raised or lowered to be thrown into the color developing tank. For simultaneous replenishment of double solution tanks, e.g., the color developing tank 212*a* and the bleaching-fixing tank 212*b*, with solid processing solutions J, the solid processing solutions for the double solution tanks are contained in the related buckets 270 and then are raised or lowered to be simultaneously thrown into the both tanks. In case where the time for replenishment of another solution tank with solid processing solutions J comes when a replenishment of a single solution tank with solid processing solutions J is under operation, the replenishment of the another solution tank with solid processing solutions J is not effected until the elevating frame 269 returns to its initial position at which the solid processing solutions J are contained in the related bucket after the former replenishment is completed.

This construction, in which each bucket 270 is mounted on a single elevation frame 269 and the single elevation frame 269 is raised or lowered by the drive of the elevation motor 264, can provides a simplified elevation mechanism, reduced costs, and further downsizing.

Next, the way of supplying the solid processing solutions will be described with reference to FIG. 34. First, the opening 2*y* of each solid processing solution cartridge 2 is set on the top of the rotor case 251 of the supplying portion 250. Then, the sliding lid 2*w* of the solid processing solution cartridge 2 is opened so that the supply of solid processing solutions can be put into practice. When the cavity 252*a* of each rotor 252 is in a position corresponding to the solid processing solution inlet 251*a*, a solid processing solution J in the solid processing solution cartridge 2 enters the cavity 252*a* of the rotor 252. Then, the rotor 252 is turned in the direction of the arrow and is stopped from rotating at a position at which the cavity 252*a* comes to be in confront with the supply opening 251 b. And, the solid processing solution J is rolled and discharged out from the supply opening 251*b*.

The discharged solid processing solution J enters the bucket 270. Then, the bucket 270 containing the solid processing solution J is raised from its lower position to its upper position. The bucket 270 has a bottom wall 270*a* tilted toward the cover 230, and the solid processing solution J contained in the bucket 270 is raised with its contacting with the cover 230 and being restrained from discharge by the cover. When the bucket 270 is moved to its upper position corresponding to an opening 230*b* of the cover 230, the solid processing solution J rolls out from the opening 230*b* and move into the shooter 216. The shooter 216 is so slanted that its dissolving tank 214 side becomes lower, so that the solid processing solution rolls down the shooter by its self weight and drops down into the dissolving tank 214.

The shooter 216 has a required number of passages each having a fixed width for solid processing solution J not to fall within the shooter. The number of passages is determined according to the number of the solid processing solutions J to be supplied from the bucket 270.

Thus, in the case where the solid processing solution supplying section 215 is located at a place different from the processing tanks 212 or the dissolving tanks 214 and under those tanks, the solid processing solutions J discharged from the solid processing solution supplying section 215 can be moved upward with their contained in the buckets 270. With this construction using the upward action of the buckets 270, a smooth and sure transference of the solid processing solutions J can be effected with simple and compact structure.

Also, after the solid processing solutions J discharged from the solid processing solution supplying section 215 are moved upward with their contained in the bucket 270 and are discharged from the bucket 270, they are transferred toward the processing tanks by use of the carriage paths formed by the shooters. Thus, a smooth and sure transference of the solid processing solutions J toward the processing tanks can be ensured.

Further, the solid processing solutions transferring portion 260 is placed in a space defined between the solid processing solution supplying section 215 and the processing tank side of the automatic paper developing machine. Through the use of the space defined between the solid processing solution supplying section 215 and the processing tank side of the automatic paper developing machine, the compact structure can be provided for a smooth and sure transference of the solid processing solutions J toward the processing tanks.

Further, since the bottom wall 270*a* of each of the buckets 270 is slanted toward the cover 230 and the solid processing solutions J contained in the each bucket 270 are raised with their contacting with the cover 230, when the each bucket 270 is moved to its upper position corresponding to an opening 230*b* of the cover 230, the solid processing solutions J can automatically move into the carriage paths formed by the shooter 216. Thus, the transference of the solid processing solutions can be made with the simple structure using the buckets 270 and the cover 230.

Next, an example for supply of two or more tablets of solid processing solutions will be described with reference to FIG. 35. In this embodiments, the each bucket 270 has side walls 270*b* at opposite ends of the bottom wall 270*a* and three partition walls 270*c* between the side walls 270*b*, so as to form four containing portions.

Two tablets of solid processing solutions J fed into the cavities 252*a* of each rotor 252 are turned and are discharged from the supply openings 251 into the containing portions of each bucket 270 positioned at the lower position. Then, the each bucket 270 containing the solid processing solutions J is raised from its lower position to its upper position. When the each bucket arrived at a lower opening 290*a* of an opening 290 formed on the cover 230, the first tablet of solid processing solution J is discharged from the bucket 270 and is fed in. Further, after expiration of a predetermined time interval, the each bucket 270 is moved upward. When the each bucket arrived at a position corresponding to an upper opening 290*b* of the opening 290 formed on the cover 230, the second tablet of solid processing solution J is discharged from the bucket 270 and is fed in.

Thus, two or more solid processing solutions J moved upward with the each bucket 270 can be supplied into the carriage paths at different locations corresponding to the openings formed on the cover 230 which are different from each other in their vertical position. Therefore, an extra upward movement can be omitted to shorten the time for supply of the solid processing solutions J, and besides the upward transference of a plurality of solid processing solutions and the supply into the processing tanks can be effected with simple structure.

It should be noted that this embodiment, which is constructed such that four tablets of solid processing solutions J are allowed to be contained in the bucket 270 and also are allowed to be discharged at two different positions corresponding to the lower opening 290*a* and the upper opening 290*b* of the opening 290, can be modified such that the opening 290 comprises a four-level opening corresponding in number to the containing portions of the bucket 270. In this modification, four tablets of solid processing solutions can be moved upward at the same time and also be supplied in four steps. The construction which is so modified that the opening 290 comprises the four-level opening corresponding in number to the containing portions of the bucket 270 may suit well for the case where one tablet or two or three tablets of solid processing solutions J are contained in the each bucket 270.

FIGS. 36(*a*) and 36(*b*) are illustrations of a modified bucket. This modified bucket 291 has a bottom wall 291*a* which is so formed as not to be slanted. The bucket 291 is elevated along the vertically disposed cover 230. The solid processing solution J contained in the bucket 291 is moved upward, as shown in FIG. 36(*a*), and is brought into contact with a cam guide 292, as shown in FIG. 36(*b*), so that it is pushed out at a position corresponding to the opening 230*a* formed on the cover 230 and is supplied into the carriage path.

Like this, the solid processing solution J, when moved upward, is brought into contact with the cam guide 292 so as to be pushed out at a position corresponding to the opening 230*a* formed on the cover 230. Thus, through the use of the upward movement of the solid processing solutions, the supply of the solid processing solution J into the carriage path can be made with simple structure.

FIG. 37(*a*) and 37(*b*) are illustrations of a further modified bucket. This modified bucket 291 is also has a bottom wall 291*a* which is so formed as not to be slanted. The bucket 291 is elevated along the vertically disposed cover 230 and thus the solid processing solution J contained in the bucket 291 is moved upward, as shown in FIG. 37(*a*). The bucket 291 is pushed up at its bottom by a cam 293 at a position corresponding to an opening of the cover 230, as shown In FIG. 37(*b*), so that the bucket 291 can be tilted toward the cover 230 to allow the solid processing solution to be fed into the carriage path.

Like this, the cam 291 allows the bucket 291 to be slanted at a position corresponding to the opening of the cover 230. Thus, with the simple structure using the cam 293, the supply of the solid processing solution J into the carriage path can be achieved.

Next, the way of setting of the solid processing solution cartridge will be described with reference to FIGS. 38, 39, 40(*a*) and 40(*b*). When the front end portion 2*x* of each solid processing solution cartridge 2 is inserted into the cartridge holder 242, if the inserted solid processing solution cartridge 2 is a suitable one, discriminating pins 2*z* at the front end 2*x* can push up a locking plate 243 engaged in an engaging hole 242*a* of the cartridge holder 242, so that the locking plate 243 is disengaged from the engaging hole 242*a*. As a result of this, the cartridge holder 242 is brought into a condition that it can pivot on the supporting pins 244.

Then, the opening end 2*y* of the each solid processing solution cartridge 2 is pivoted in the direction of the arrow, as shown in FIG. 38, and thereby the cartridge is set in the loading portion 240, as shown in FIG. 39. Thus, the solid processing solution cartridge 2 is set in place by pivoting the cartridge holder 242. At the time when the solid processing solution cartridge 2 is set in place, a wrong operation preventing sensor 246 detects a wrong operation preventing sensor plate 245, so that the rotor 252 of the supplying portion 250 is brought into an operable condition. If the wrong operation preventing sensor 246 fails to detect the wrong operation preventing sensor plate 245, on the other hand, the rotor 252 does not operate.

Thus, the wrong operation preventing sensor plate 245 and the wrong operation preventing sensor 246 form a insertion sensing means 280 for sensing an inserting motion of the solid processing solution cartridge 2. And, the detection result of the insertion sensing means 280 permits the solid processing solution supplying section 215 to work to make the supply of the solid processing solutions J contained in the solid processing solution cartridge 2.

Like this, since the each solid processing solution cartridge 2 inserted in the solid processing solution supplying section 215 is detected by the insertion sensing means 280 and the detection result of the insertion sensing means 280 determines operation of the solid processing solution supplying section 215, there is no fear that the solid processing solution supplying section 215 operates under a condition that some dust or paper occurring in the work is in a solid processing solution inlet 215*a* of the solid processing solution supplying section 215. Thus, the solid processing solution inlet 215*a* of the solid processing solution supplying section 215 can be protected from clogging of risk, paper or the like to diminish the risk of malfunction and machine trouble, thus achieving improved durability.

Figure 41:
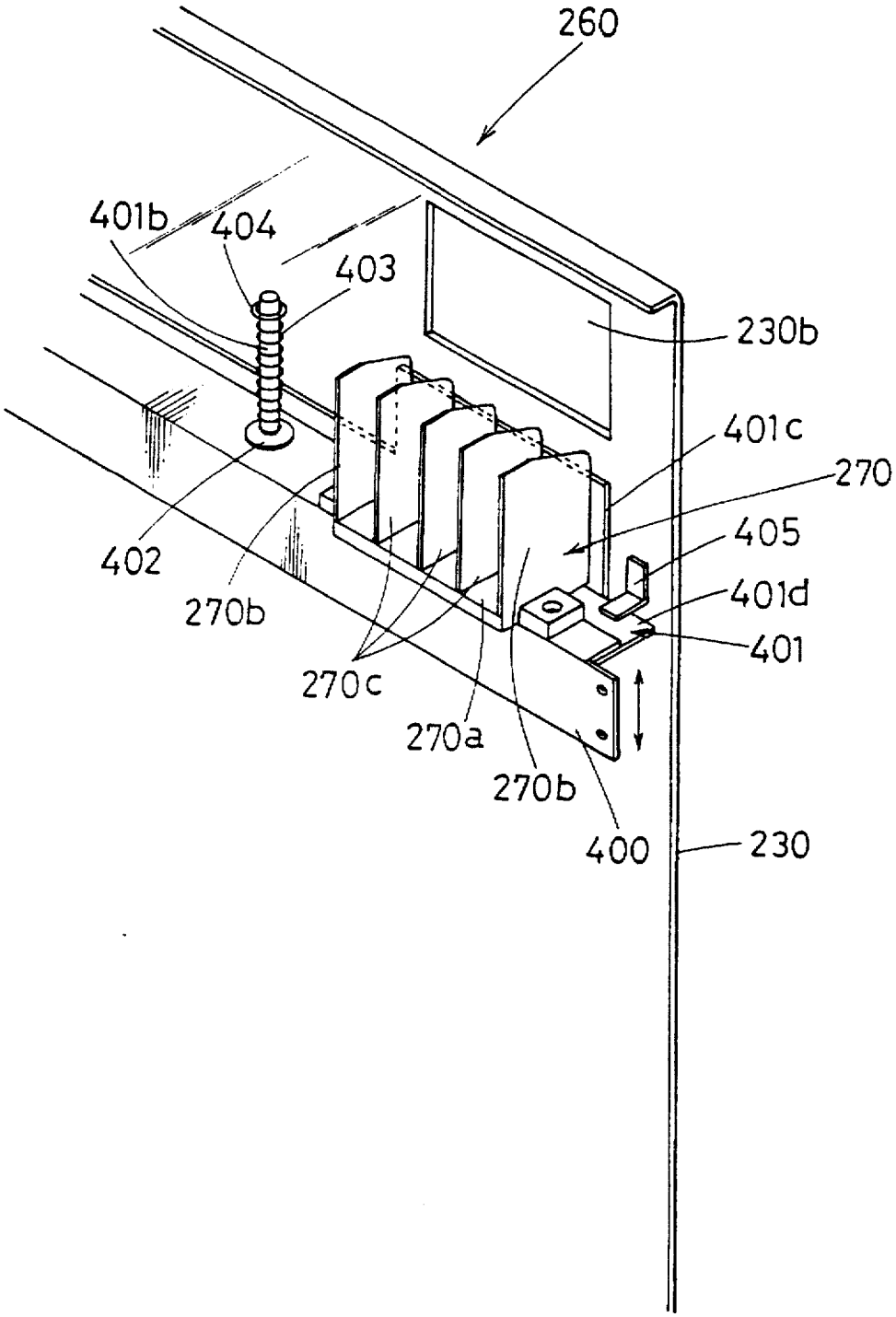
FIG. 41 is a schematic perspective view of another embodiment of the solid processing solution transferring section.
Figure 42:
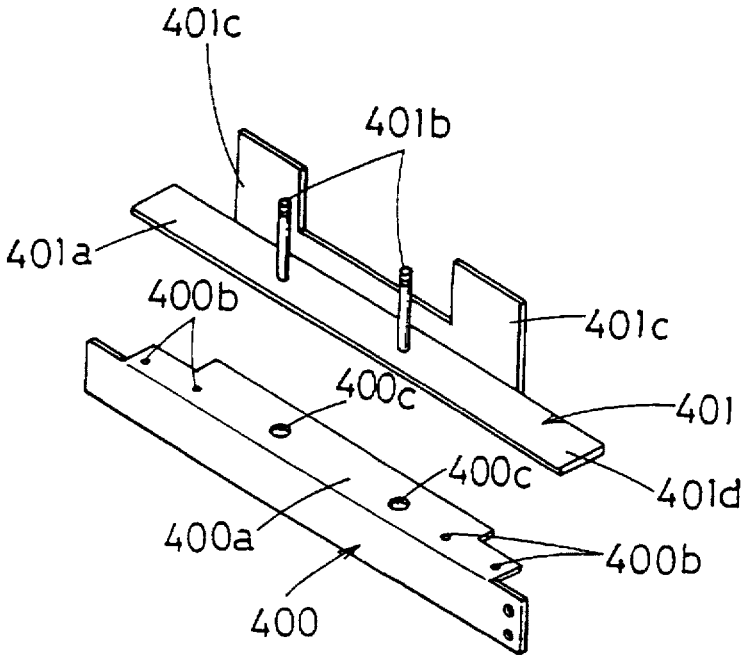
FIG. 42 is an exploded perspective view of a bucket holder and a shutter of the another embodiment of the solid processing solution supplying section.
Figure 43B:
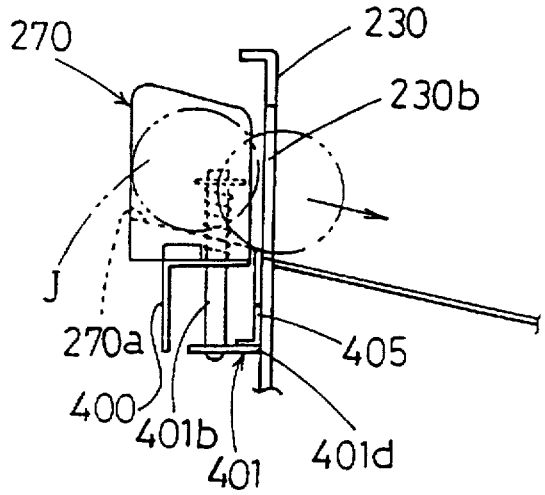
FIGS. 43(*a*) and 43(*b*) are illustrations showing the bucket holder and the shutter of the another embodiment in an operating condition.
Figure 43:
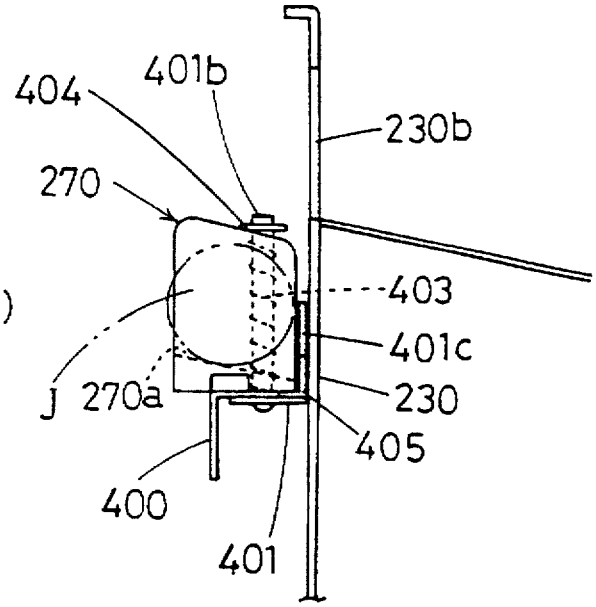

FIGS. 41, 42, 43(*a*) and 43(*b*) show another embodiment of the solid processing solution transferring section 260. In this embodiment, the solid processing solution transferring section 260 is modified so that the solid processing solutions J contained in each bucket 270 which moves upward along the cover 230 can be prevented from being worn by its contacting with the cover 230 during the upward movement.

The each bucket 270 is provided between its two side plates with a plurality of partition walls 270*c*so as to define a plurality of containing portions for individually containing each solid processing solution J, in the same manner as in the former embodiment. Also, the bucket 270 has a bottom surface 270*a* which is so slanted that its cover 230 side becomes lower. Further, the bucket 270 is fixed on a top surface 400*a* of a bucket holder 400 of an inverted letter L-like shape in section with screws (omitted from representation). 400*b* denotes bucket mounting holes. Two holes 400*c* are formed on the top surface 400*a* of the bucket holder 400 with their spaced from each other at an predetermined interval.

Also, a shutter 401, movable together with the bucket holder 400 and the bucket 270 and having a letter L-like shape, is provided with spring supporting shafts 401*b* to be inserted into the two holes 400*c* of the bucket holder 400. A side wall 401*c* of the shutter 401 has a size enough to cover the cover 230 side of the bucket 270 to protect the solid processing solutions J contained in the bucket 270 from contacting with the cover 230 during their upward movement.

The spring supporting shafts 401*b* are inserted into the holes 400*c* on the top surface 400*a* of the bucket holder 400 so that a bottom surface 401*a* of the shutter 401 can contact with the underside of the top surface 400*a* of the bucket holder 400.

Each of the spring supporting shafts 401*b* projecting from the holes 400*c* on the top surface 400*a* of the bucket holder 400 is provided with a washer 402 and a coil spring 403 and is further provided at its top end with a retaining ring 404 so that the coil spring 403 can be held by the spring supporting shaft 401*b*.

Further, a stopper 405 is provided on the cover 230 at a position slightly below the opening 230*b* formed on the cover 230, so that the shutter 401 moving upward can be retained at the end 401*d* and prevented from further upward movement by the stopper.

By virtue of the above construction, the solid processing solutions J, contained in the bucket 270 movable along the cover 230 together with the bucket holder 400 and the shutter 401, are protected from contacting with the cover 230 (wearing) by the side wall 401*c* of the shutter 401. Therefore, the solid processing solutions J can be kept from wear and the shatters can be kept from dispersing in various directions.

As shown in FIG. 43(*a*), when the solid processing solutions J contained in the bucket 270 are moved up to the position before the opening 230*b* of the cover 230, the end 401*d* of the shutter 401 comes to contact with the stopper 405 formed on the cover 230, so that only the shutter 401 is stopped from further upward movement and is retained at that position.

On the other hand, as shown in FIG. 43(*b*), the bucket 270 containing the solid processing solutions J and the bucket holder 400 are both moved up further against resilient urge of the coil springs 403 held by the spring supporting shafts 401*b* at the shutter 401 which was stopped in movement. And, the solid processing solutions J are allowed by the slanted bottom surface 270*a* of the bucket 270 to be fed from the opening 230*b* toward the processing tanks through the carriage paths.

Figure 44:
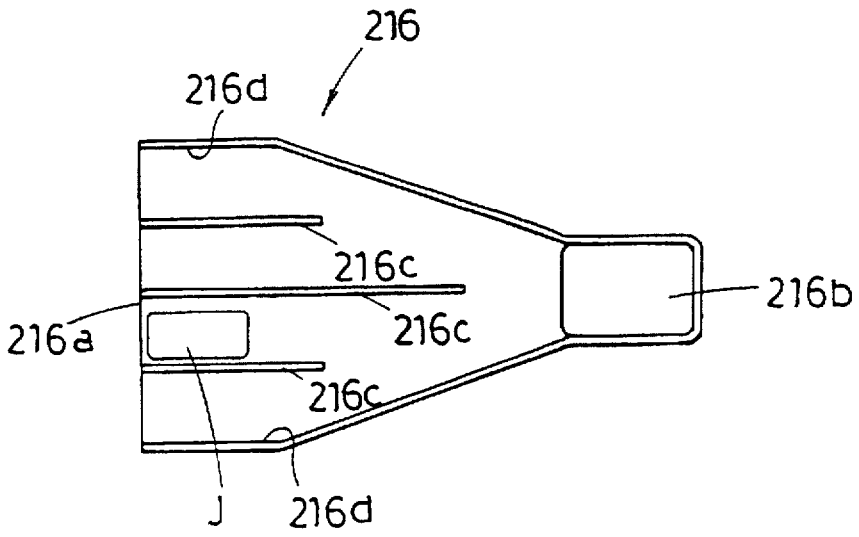
FIG. 44 is a plan view of a modified shooter.
Figure 45:
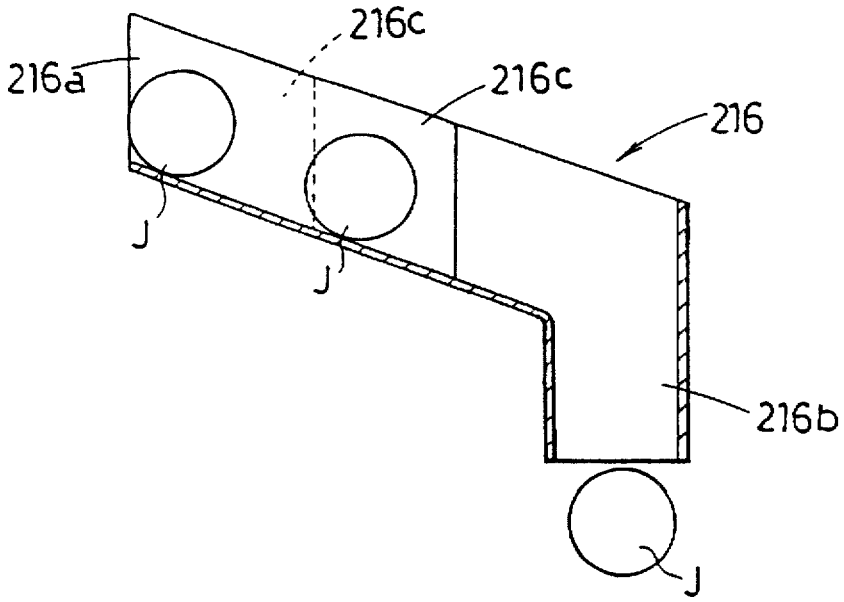
FIG. 45 is a longitudinal section view of the modified shooter.

FIGS. 44 and 45 show a modified shooter 216. This shooter 216 includes a plurality of tablet tripping partition walls 216*c* which extend in parallel in a longitudinal direction from a shooter inlet 216*a* side of the shooter 216 larger in width toward a shooter outlet 216*b* side of the shooter 216 smaller in width and also correspond in width to the solid processing solutions J arrayed in the bucket 70.

An interval between adjacent partition walls 216*c* and an interval between a shooter wall 216*d* and the partition wall 216*c* opposite thereto are set to be slightly larger than a width of each individual solid processing solution J so that the each solid processing solution J can surely be rolled from the inlet of the shooter 216 to the outlet of the same without tripping.

This can prevent a possible risk that a solid processing solution J trips at some midpoint of the shooter 216 and following solid processing solutions J trip at that point one after another and thereby the shooter 216 is plugged with those solid processing solutions J.

Availability to Industry

As mentioned above, according to the invention of claim 1, in the case where the solid processing solution supplying section is located at a place different from the processing tanks and the dissolving tank and below those tanks, the solid processing solution delivered from the solid processing solution supplying section can be carried upward with its contained in the bucket. This can provide the results that with the structure simplified by use of the upward movement of the buckets, the automatic developing machine can be made compact in size and also a smooth and reliable carriage of the solid processing solutions can be ensured.

According to the invention of claim 2, after the solid processing solutions delivered from the solid processing solution supplying section are carried upward with their contained in the buckets, the solid processing solutions delivered from the buckets are transported toward the processing tanks by the carriage paths. This ensures a smooth and reliable carriage of the solid processing solutions toward the processing tanks.

According to the invention of claim 3, the solid processing solution transferring section is located between the solid processing solution supplying section and the processing tanks. This enables the automatic developing machine to be made compact in size and also enhances a smooth and reliable carriage of the solid processing solutions to the processing tanks.

According to the invention of claim 4, the bottom of the bucket is slanted to the cover, and the solid processing solution contained in the bucket is carried upward with its held by the cover and is fed into the carriage path at an opening provided at the cover. This can provide the result that the solid processing solution can be carried with simple structure using the bucket in combination with the cover.

According to the invention of claim 5, two or more solid processing solutions are carried upward by the bucket and are supplied into the carriage path at openings which are so formed on the cover as to be different in vertical level from each other. Thus, surplus upward movement can be omitted so that the time required to supply the solid processing solutions can be shortened, while also the two or more solid processing solutions can be carried upward and fed toward the processing tanks, with simply structure.

According to the invention of claim 6, the solid processing solution moving upward is brought into contact with the cam guide and is pushed out by the cam guide at a position corresponding to the opening formed on the cover. Thus, the supply of the solid processing solution to the carriage path can be made with simple structure utilizing the upward movement of the solid processing solution.

According to the invention of claim 7, the bucket is tilted by the cam at a position corresponding to an opening formed on the cover. Thus, the supply of the solid processing solution to the carriage path can be effected with simple structure using the cam.

According to the invention of claim 8, the solid processing solution, contained in the bucket movable upward along the cover, can be protected from contacting with the cover to avoid wear or fly-off the worn solid processing solution, when it is carried upward and fed into the carriage paths.

According to the invention of claim 9, a dropping track, which is for allowing the plurality of solid processing solutions to drop by gravity into a plurality of supplying paths for the solid processing solutions to be fed in, comprises a plurality of dropping passages and allows the solid processing solutions at the endpoints of the dropping track to be kept in substantially the same attitude. Thus, a plurality of solid processing solutions can be collected and supplied smoothly without clogging or jamming.

According to the invention of claim 10, a holding means for preventing drop of the solid processing solution cartridge is provided at a position where the solid processing solution cartridge containing the solid processing solutions is inserted. Thus, the solid processing solution cartridge can be held by the holding means with a simple insertion loading. This allows the solid processing solution cartridge to be held with simple structure and also allows an operator to attach or detach the cartridge even with his/her one hand, thus proving improved workability.

According to the invention of claim 11, the holding means for holding the solid processing solution cartridge is formed of spring steel, so that for example simply bending a sheet of spring steel allows the solid processing solution cartridge to be grasped and held so as not to drop. This requires the reduced number of parts and adjustment-free, thus enabling the holding means to be hard to breakage and ensuring the holding action.

According to the invention of claim 12, the solid processing solution cartridge holding element is provided at the front ends thereof with rollers. Free rotation of the rollers which occurs when the solid processing solution cartridge is attached or detached facilitates the attachment or detachment of the solid processing solution cartridge with one hand, thus providing further improved operability.

According to the invention of claim 13, the solid processing solution cartridge holding element is provided at the front ends thereof with folded portions each having a slippery member at the inside. At the time of attaching or detaching the solid processing solution cartridge, sliding effect of the slippery members facilitates the attachment or detachment of the solid processing solution cartridge with one hand.

According to the invention of claim 14, the solid processing solution cartridge inserted in the solid processing solution supplying section is sensed by the sensing means, and the sensing result determines the operation of the solid processing solution supplying section. This can avoid a possible risk that the solid processing solution supplying section may operate under the state that rust, paper or the like is in an solid processing solution inlet of the solid processing solution supplying section. Thus, the clogging of rust, paper or the like can be prevented and a possible risk of machine trouble or malfunction can be diminished, thereby achieving improved durability.

We claim:

1. An automatic photosensitive material developing machine for supplying a solid processing solution to be dissolved according to consumption of processing solution for a silver halide photosensitive material to be treated, said developing machine comprising:

a solid processing solution supplying section for supplying the solid processing solution from a solid processing solution cartridge containing said solid processing solution, and a solid processing solution transferring section for receiving the solid processing solution supplied by the solid processing solution supplying section in a bucket, and for transferring the bucket upward.

2. An automatic photosensitive material developing machine for supplying a solid processing solution to be dissolved according to consumption of processing solution for a silver halide photosensitive material to be treated, said developing machine comprising:

a solid processing solution supplying section for supplying said solid processing solution from a solid processing solution cartridge containing said solid processing solution, a solid processing solution transferring section for receiving the solid processing solution supplied by said solid processing solution supplying section in a bucket, and for transferring the bucket upward, and a carriage path for directing said bucket containing said solid processing solution toward processing tanks.

3. The automatic photosensitive material developing machine according to claim 2, wherein said solid processing solution transferring section is located between said solid processing solution supplying section and said processing tanks.

4. The automatic photosensitive material developing machine according to claims 2 or 3, wherein said bucket is movable up and down along a cover and has a bottom slanted toward the cover, so that said solid processing solution contained in the bucket is carried upward in a state of contact with said cover and is fed into said carriage path at a position corresponding to an opening formed on the cover.

5. The automatic photosensitive material developing machine according to claims 2 or 3, wherein said bucket comprises at least one partition plate for separating at least two solid processing solutions, and a cover having openings at different vertical levels for supplying said at least two said processing solutions into said carriage path at positions corresponding to said openings.

6. The automatic photosensitive material developing machine according to claims 2 or 3, wherein said bucket is movable up and down along a cover and the solid processing solution contained in said bucket is movable upward and can be brought into contact with a cam guide during upward movement so as to be pushed out by said cam guide at a position corresponding to an opening formed on said cover to thereby be fed into said carriage path.

7. The automatic photosensitive material developing machine according to any one of the claims 1 to 3, wherein said bucket is movable up and down along a cover so that the solid processing solution contained in said bucket is movable upward, and said bucket is tilted by a cam at a position corresponding to an opening formed on said cover so that the solid processing solution can be fed into said carriage path.

8. The automatic photosensitive material developing machine according to claims 2 or 3, wherein said bucket is movable up and down along a cover, together with a bucket holder and a shutter for preventing the solid processing solution contained in said bucket from contacting with said cover, said shutter being prevented from moving upward during upward movement of said bucket by a shutter stopper provided before an opening formed on the cover, whereby said bucket can be raised together with said bucket holder and the solid processing solution contained in said bucket can be fed into said carriage path at a position corresponding to the opening formed on said cover.

9. A photographic processing solution replenishing apparatus for supplying solid processing solutions to be dissolved according to consumption of processing solutions for a silver halide photosensitive material to be treated, said apparatus comprising:

a dropping track from which the plurality of solid processing solutions drop by gravity into a plurality of supplying paths, said dropping track comprising a plurality of dropping passages which permit the solid processing solutions at endpoints of the dropping track to be kept in substantially a same attitude, and a solid processing solution transferring section for transferring the solid processing solutions to the endpoints of said dropping track.

10. A photographic processing solution replenishing apparatus for supplying solid processing solutions to be dissolved according to consumption of processing solutions for a silver halide photosensitive material to be treated, wherein a solid processing solution cartridge containing the solid processing solutions is insertable into said apparatus, said apparatus comprising:

a solid processing solution supplying section which is configured so that said solid processing solution cartridge can be set in a vertical position for the solid processing solutions to be supplied therefrom, and a holding means for preventing a drop of said solid processing solution cartridge, said holding member being provided at a position where said solid processing solution cartridge containing the solid processing solutions is inserted.

11. The photographic processing solution replenishing apparatus according to claim 10, wherein said holding means for holding said solid processing solution cartridge is formed of spring steel.

12. The photographic processing solution replenishing apparatus according to claims 10 or 11, wherein said holding means for holding said solid processing solution cartridge is formed by a solid processing solution cartridge holding element which is provided at front ends thereof with rollers.

13. The photographic processing solution replenishing apparatus according to claims 10 or 11, wherein the holding means for holding the solid processing solution cartridge is formed by a solid processing solution cartridge holding element which is provided at front ends thereof with folded portions having slippery members at an inside thereof.

14. A photographic processing solution replenishing apparatus for supplying solid processing solutions to be dissolved according to consumption of processing solutions for a silver halide photosensitive material to be treated, wherein a solid processing solution cartridge containing the solid processing solutions is insertable into said apparatus, said apparatus comprising:

a solid processing solution supplying section which is configured so that said solid processing solution cartridge can be set in a position for the solid processing solutions to be supplied therefrom, and a sensor for sensing an inserting motion of said solid processing solution cartridge when said solid processing solution cartridge is properly inserted in said apparatus, and for generating a signal responsive thereto for enabling the solid processing solution supplying section to operate to supply the solid processing solutions contained in the solid processing solution cartridge.

* * * * *